US010347985B2

(12) United States Patent
Kim et al.

(10) Patent No.: US 10,347,985 B2
(45) Date of Patent: Jul. 9, 2019

(54) ANTENNA DEVICE AND ELECTRONIC DEVICE INCLUDING THE SAME

(71) Applicant: Samsung Electronics Co., Ltd., Suwon-si, Gyeonggi-do (KR)

(72) Inventors: Hyunjin Kim, Seoul (KR); Kwanghyun Baek, Hwaseong-si (KR); Byungchul Kim, Yongin-si (KR); Jungmin Park, Seoul (KR); Youngju Lee, Seoul (KR); Sungchul Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/685,363

(22) Filed: Aug. 24, 2017

(65) Prior Publication Data

US 2018/0062256 A1 Mar. 1, 2018

(30) Foreign Application Priority Data

Aug. 25, 2016 (KR) ..... 10-2016-0108334

(51) Int. Cl.

| | |
|---|---|
| ***H01Q 1/52*** | (2006.01) |
| ***H01Q 1/24*** | (2006.01) |
| ***H01Q 13/02*** | (2006.01) |
| ***H01Q 13/08*** | (2006.01) |
| ***H01Q 21/24*** | (2006.01) |
| *H01P 5/107* | (2006.01) |

(52) U.S. Cl.

CPC ..... *H01Q 1/525* (2013.01); *H01Q 1/243* (2013.01); *H01Q 13/02* (2013.01); *H01Q 13/085* (2013.01); *H01Q 21/24* (2013.01); *H01P 5/107* (2013.01)

(58) Field of Classification Search

CPC ..... H01Q 1/525; H01Q 3/00; H01Q 13/02
USPC ..... 343/702
See application file for complete search history.

(56) References Cited

U.S. PATENT DOCUMENTS

| | | | | |
|---|---|---|---|---|
| 7,872,609 | B2 | 1/2011 | Ou et al. | |
| 8,674,885 | B2 | 3/2014 | Leiba et al. | |
| 9,196,952 | B2 * | 11/2015 | Tran | H01Q 1/243 |
| 9,806,421 | B1 * | 10/2017 | Pajona | H04W 4/80 |
| 2009/0312054 | A1 | 12/2009 | Choi | |
| 2011/0037530 | A1 | 2/2011 | Mangalahgari et al. | |

(Continued)

FOREIGN PATENT DOCUMENTS

| | | | |
|---|---|---|---|
| JP | 2013-013144 | A | 1/2013 |
| JP | 5910706 | B2 | 4/2016 |
| KR | 10-2015-0051959 | A | 5/2015 |

OTHER PUBLICATIONS

International Search Report dated Jan. 24, 2018, issued in International Application No. PCT/KR2017/009272.

*Primary Examiner* — Peguy Jean Pierre
(74) *Attorney, Agent, or Firm* — Jefferson IP Law, LLP

(57) ABSTRACT

An electronic device is provided that includes a circuit board received in the electronic device and in which at least one board is layered, a communication module disposed at one surface of the circuit board and electrically connected to the circuit board, an antenna electrically connected to the communication module, and a metal structure whose one surface is separated from the other surface of the circuit board to form a space within the electronic device by enclosing the circuit board and in which at least one aperture is formed at one side thereof.

25 Claims, 36 Drawing Sheets

(56) References Cited

U.S. PATENT DOCUMENTS

| | | | | |
|---|---|---|---|---|
| 2013/0241792 | A1* | 9/2013 | Ishikawa | H01Q 1/38 343/848 |
| 2013/0286582 | A1* | 10/2013 | Dabov | H01Q 1/243 361/679.55 |
| 2014/0247188 | A1 | 9/2014 | Nakano et al. | |
| 2015/0024810 | A1 | 1/2015 | Kwon et al. | |
| 2015/0050968 | A1 | 2/2015 | Jeon et al. | |
| 2017/0324135 | A1* | 11/2017 | Blech | H01P 3/121 |

* cited by examiner

ANTENNA DEVICE AND ELECTRONIC DEVICE INCLUDING THE SAME

CROSS-REFERENCE TO RELATED APPLICATION(S)

This application claims the benefit under 35 U.S.C. § 119(a) of a Korean patent application filed on Aug. 25, 2016 in the Korean Intellectual Property Office and assigned Serial number 10-2016-0108334, the entire disclosure of which is hereby incorporated by reference.

TECHNICAL FIELD

The present disclosure relates to an antenna device and an electronic device including the same that can transmit and receive various bands of frequencies.

BACKGROUND

Efforts are being made to develop an enhanced 5th generation (5G) communication system or a pre-5G communication system in order to satisfy increase in demand for wireless data traffic as a $4^{th}$ generation (4G) communication system is now commercially available.

In order to achieve a high data transmission rate, consideration is being given to implementing the 5G communication system in a mmWave band (e.g., 60 GHz band). In order to mitigate any route loss of electronic waves in a mmWave band and to increase transmission distances of electronic waves, the technologies of beamforming, massive multiple input and output (MIMO), full dimensional MIMO (FD-MIMO), array antenna, analog beamforming, and large scale antenna have been discussed for the 5G communication system.

Further, an external shape of electronic devices is generally made of a dielectric substance for transmission and reception of electric waves, but nowadays, because of demand for an enhanced external appearance, a case or a frame of a metal material is mounted to the electronic device.

There are problems that a dielectric loss increases as a frequency increases and that antenna radiation efficiency is deteriorated because of a metal material constituting at least a portion of an external shape of an electronic device.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna device and an electronic device including the same that can transmit and receive various bands of frequencies as well as a frequency of a mmWave.

In accordance with an aspect of the present disclosure, an electronic device is provided. The electronic device includes a frame that forms a space between a front surface and a rear surface and that encloses the space includes an antenna device having at least a portion connected to the frame and disposed at the space, wherein the antenna device includes a circuit board of a plate structure in which at least one board is layered, a tapered slot antenna disposed in at least a portion of the circuit board, a communication module disposed at the circuit board, and a feed terminal disposed at the circuit board to electrically connect the tapered slot antenna and the communication module, wherein the tapered slot antenna includes at least one vertical polarization tapered slot antenna having a portion coupled to the circuit board and the frame, and at least one horizontal polarization tapered slot antenna having a portion coupled to the circuit board.

In accordance with another aspect of the present disclosure, an electronic device is provided. The electronic device includes a frame that forms a space between a front surface and a rear surface and that encloses the space includes an antenna device having at least a portion connected to a cover disposed at the rear surface and disposed at the space, wherein the antenna device includes a circuit board of a plate structure in which at least one board is layered, at least one waveguide antenna formed in a waveguide shape using at least a portion of the circuit board and at least a portion of the cover, a patch antenna disposed at one end of the circuit board, a communication module disposed at the circuit board, and a feed terminal disposed at the circuit board to electrically connect the at least one waveguide antenna and the communication module.

In accordance with another aspect of the present disclosure, an antenna device coupled to a frame forming an external shape of an electronic device is provided. The antenna device includes a circuit board of a plate structure in which at least one board is layered, a tapered slot antenna disposed in at least a portion of the circuit board, and a feed terminal disposed at the circuit board to electrically connect the tapered slot antenna and the circuit board, wherein the tapered slot antenna includes at least one vertical polarization tapered slot antenna having a portion coupled to the circuit board and the frame, and at least one horizontal polarization tapered slot antenna having a portion coupled to the circuit board.

In accordance with another aspect of the present disclosure, an antenna device coupled to a cover forming an external shape of an electronic device is provided. The antenna device includes a circuit board of a plate structure in which at least one board is layered, at least one waveguide antenna formed in a waveguide shape using at least a portion of the circuit board and at least a portion of the cover, a patch antenna disposed at one end of the circuit board, a communication module disposed at the circuit board, and a feed terminal disposed at the circuit board to electrically connect the at least one waveguide antenna and the communication module.

In accordance with another aspect of the present disclosure, an electronic device is provided. The electronic device includes a housing including a first surface, a second surface facing in a direction opposite to that of the first surface, and a side surface that encloses a space between the first surface and the second surface, a first conductive member included in the housing, an opening portion included in the first conductive member and extended in a direction vertical to the first conductive member, and a waveguide including the opening portion, wherein the waveguide is at least a portion of a first antenna that transmits a signal of a first frequency range, and the first conductive member is at least a portion of a second antenna that transmits a signal of a second frequency range.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
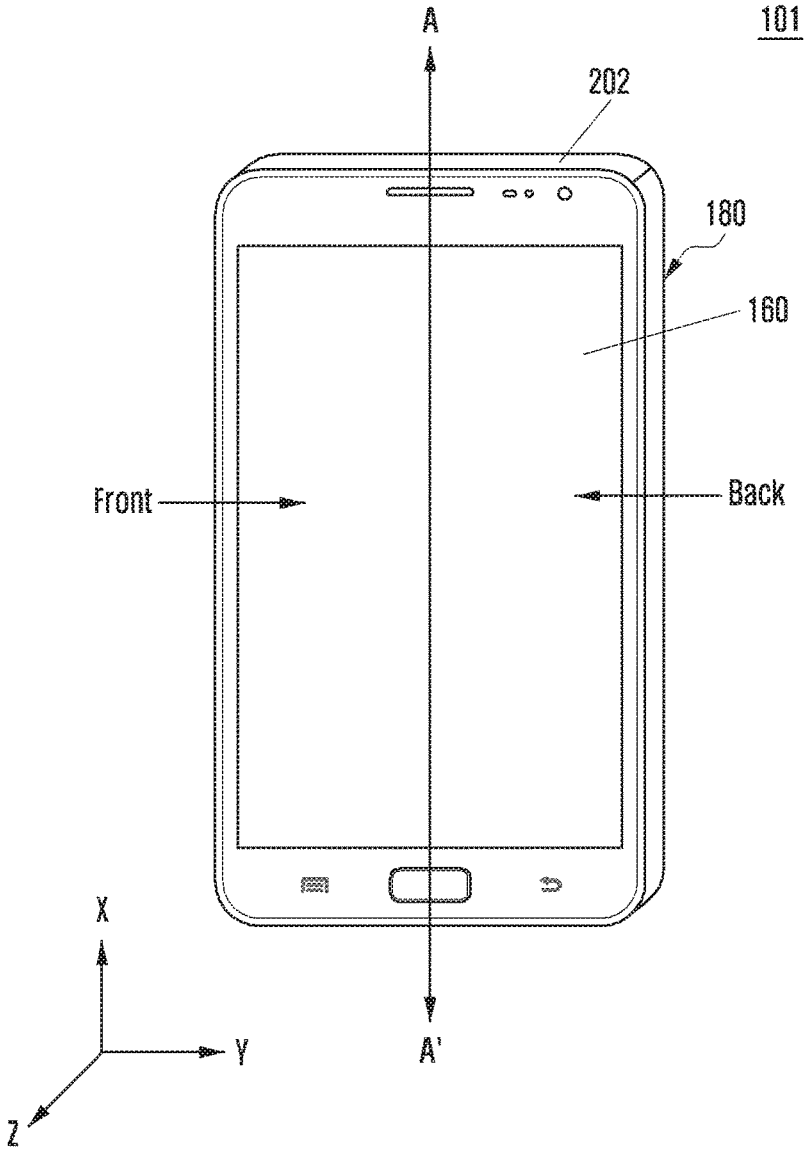
FIG. 1 is a perspective view illustrating an electronic device according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely c. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

When using in a description of this document and the appended claims, a singular expression may include a plurality of expressions unless explicitly differently represented. In this document, an expression such as "A or B" and "at least one of A or/and B" may include all possible combinations of together listed items. An expression such as "first" and "second" used in this document may indicate corresponding constituent elements regardless of order and/or importance, is used for distinguishing a constituent element from another constituent element, and does not limit corresponding constituent elements. When it is described that a constituent element (e.g., a first constituent element) is "(functionally or communicatively) coupled to" or is "connected to" another constituent element (e.g., a second constituent element), it should be understood that the constituent element may be directly connected to the other constituent element or may be connected to the other constituent element through another constituent element (e.g., a third constituent element).

In this document, "configured to (or set to) " may be interchangeably used with, for example, "appropriate to" in hardware or software, "having a capability to," "changed to," "made to," " capable of," or "designed to" according to a situation. In any situation, an expression "device configured to" may mean that the device is "capable of" being configured together with another device or component. For example, a "processor configured to (or set to) perform phrases A, B, and C" may mean an exclusive processor (e.g., an embedded processor) for performing a corresponding operation or a generic-purpose processor (e.g., central processing unit (CPU) or application processor) that can perform a corresponding operation by executing at least one software program stored at a memory device.

An electronic device according to various embodiments of this document may include at least one of, for example, a smart phone, tablet personal computer (PC), mobile phone, video phone, electronic book reader, desktop PC, laptop PC, netbook computer, workstation, server, personal digital assistant (PDA), portable multimedia player (PMP), moving picture experts group layer-3 Audio (MP3) player, medical device, camera, or wearable device. The wearable device may include at least one of an accessory type device (e.g., watch, ring, bracelet, ankle bracelet, necklace, glasses, contact lens), head-mounted-device (HMD), textile or clothing integral type device (e.g., electronic clothing), body attachment type device (e.g., skin pad or tattoo), or bio implantable circuit. In an embodiment, the electronic device may include at least one of, for example, a television, digital video disk (DVD) player, audio device, refrigerator, air-conditioner, cleaner, oven, microwave oven, washing machine, air cleaner, set-top box, home automation control panel, security control panel, media box (e.g., Samsung HomeSync™, AppleTV™, or Google TV™), game console (e.g., Xbox™, PlayStation™), electronic dictionary, electronic key, camcorder, or electronic frame.

In another embodiment, the electronic device may include at least one of various medical devices (e.g., various portable medical measurement devices (blood sugar measurement device, heartbeat measurement device, blood pressure measurement device, or body temperature measurement device), magnetic resonance angiography (MRA) device, magnetic resonance imaging (MRI) device, computed tomography (CT) device, scanning machine, and ultrasonic wave device), navigation device, global navigation satellite system (GNSS), event data recorder (EDR), flight data recorder (FDR), vehicle infotainment device, ship electronic equipment (e.g., ship navigation device, gyro compass), avionics, security device, vehicle head unit, industrial or home robot, drone, automatic teller's machine (ATM) of a financial institution, point of sales (POS) of store, or Internet of things (e.g., bulb, various sensors, sprinkler, fire alarm, thermostat, street light, toaster, exercise device, hot water tank, heater, boiler). According to an embodiment, the electronic device may include at least one of furniture, a portion of a building/structure or a vehicle, electronic board, electronic signature receiving device, projector, or various measurement devices (e.g., water supply, electricity, gas, or electric wave measurement device). In various embodiments, the electronic device may be flexible or may be two or more combinations of the foregoing various apparatus. An electronic device according to various embodiments of this document is not limited to the foregoing devices. In this document, a term 'user' may indicate a person using an electronic device or a device (e.g., artificial intelligence electronic device) using an electronic device.

FIG. 1 is a perspective view illustrating an electronic device 101 according to various embodiments of the present disclosure.

Referring to FIG. 1, the electronic device 101 may include a display 160 that exposes at least a portion of an external appearance in a front direction and include a cover 180 in a back direction. A front surface of the electronic device 101 may have a shape of substantially a rectangle or a square. The electronic device 101 may mount a component or a circuit (e.g., antenna device, processor, printed circuit board (PCB), memory, communication module) necessary for operation thereof at a space between a front surface and a rear surface. The electronic device 101 may include a frame 202 that encloses a space between a front surface and a rear surface to protect an internal space thereof. The electronic device 101 may configure an external shape with the display 160, the cover 180, and the frame 202 and may be substantially a cuboid. The cover 180 may be made of an insulator (or a dielectric substance) or a metal material. The frame 202 may be made of an insulator (or dielectric substance) or a metal material.

Figure 2:
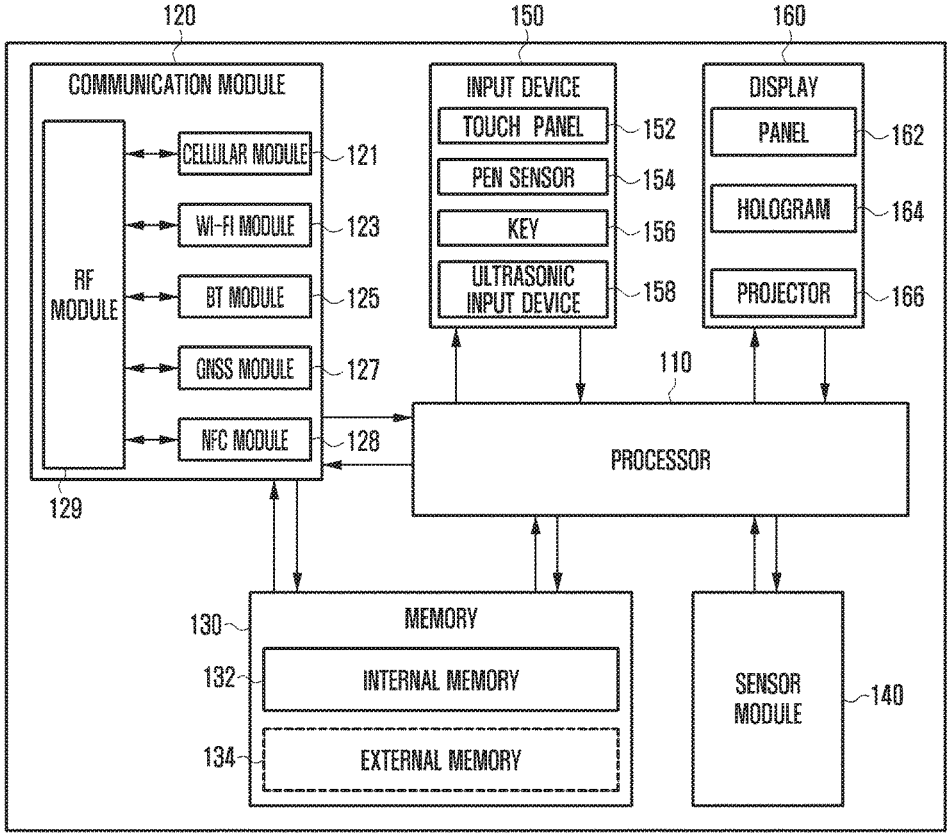
FIG. 2 is a block diagram illustrating a configuration of an electronic device according to various embodiments of the present disclosure.

FIG. 2 is a block diagram illustrating a configuration of an electronic device 101 according to various embodiments.

Referring to FIG. 2, the electronic device 101 may include at least one processor (e.g., application processor (AP)) 110, a communication module 120, a memory 130, a sensor module 140, an input device 150, and a display 160.

By driving, for example, an operation system or an application program, the processor 110 may control a plurality of hardware or software components connected thereto and perform various data processing and calculation. The processor 110 may be implemented into, for example, a system on chip (SoC). According to an embodiment, the processor 110 may further include a graphic processing unit (GPU) and/or an image signal processor. The processor 110 may include at least a portion (e.g., a cellular module 121) of constituent elements of FIG. 2. The processor 110 may load and process an instruction or data received from at least one of other constituent elements (e.g., a nonvolatile memory) at a volatile memory and store result data at the nonvolatile memory.

The communication module 120 may include, for example, a cellular module 121, WiFi module 123, Bluetooth module 125, global navigation satellite system (GNSS) module 127, near field communication (NFC) module 128, and radio frequency (RF) module 129.

The cellular module 121 may provide audio dedicated communication, audiovisual communication, a text service, or an Internet service through, for example, a communication network. According to an embodiment, the cellular module 121 may perform identification and authentication of the electronic device 101 within a communication network using a subscriber identity module (e.g., subscriber identification module (MI) card).

According to an embodiment, the cellular module 121 may perform at least a partial function of functions in which the processor 110 may provide. According to an embodiment, the cellular module 121 may include a communication processor (CP). According to various embodiments, at least a portion (e.g., two or more) of the cellular module 121, the WiFi module 123, the Bluetooth module 125, the GNSS module 127, and the NFC module 128 may be included in one integrated chip (IC) or an IC package.

The RF module 129 may transmit and receive, for example, a communication signal (e.g., an RF signal). The RF module 129 may include, for example, a transceiver, power amp module (PAM), frequency filter, low noise amplifier (LNA), or antenna.

According to various embodiments, at least one of the cellular module 121, WiFi module 123, Bluetooth module 125, GNSS module 127, or NFC module 128 may transmit and receive an RF signal through a separate RF module. The memory 130 may include, for example, an internal memory 132 or an external memory 134. The internal memory 132 may include at least one of, for example, a volatile memory (e.g., dynamic read-only memory (DRAM), static read-only memory (SRAM), or synchronous dynamic read-only memory (SDRAM)), nonvolatile memory (e.g., one time programmable ROM (OTPROM)), programmable read-only memory (PROM), erasable programmable read only memory (EPROM), electrically erasable and programmable read only memory (EEPROM), mask ROM, flash ROM, flash memory, hard drive, or solid state drive (SSD). The external memory 134 may include a flash drive, for example, compact flash (CF), secure digital (SD), Micro-SD, Mini-SD, extreme digital (xD), multi-media card (MMC), or memory stick. The external memory 134 may be functionally or physically connected to the electronic device 101 through various interfaces.

The sensor module 140 may measure, for example, a physical quantity or detect an operation state of the electronic device 101 and convert measured or detected information to an electric signal. The sensor module 140 may include at least one of, for example, a gesture sensor, gyro sensor, atmospheric pressure sensor, magnetic sensor, acceleration sensor, grip sensor, proximity sensor, color sensor (e.g., red, green, and blue (RGB) sensor), bio sensor, temperature/humidity sensor, illumination sensor, or ultra violet (UV) sensor. Additionally or alternatively, the sensor module 140 may include, for example, an e-nose sensor, electromyograph (EMG) sensor, electroencephalogram (EEG) sensor, electrocardiogram (ECG) sensor, infrared (IR) sensor, iris sensor and/or fingerprint sensor. The sensor module 140 may further include a control circuit for controlling at least one sensor that belongs therein. In an embodiment, the electronic device 101 further includes a processor configured to control the sensor module 140 as a portion of the processor 110 or separately from the processor 110, and when the processor 110 is in a sleep state, the electronic device 101 may control the sensor module 140.

The input device 150 may include a touch panel 152, (digital) pen sensor 154, key 156, or ultrasonic wave input device 158. The touch panel 152 may use at least one method of, for example, capacitive, resistive, infrared ray, and ultrasonic wave methods. The touch panel 152 may further include a control circuit. The touch panel 152 may further include a tactile layer to provide a tactile response to a user. The (digital) pen sensor 154 may be, for example, a portion of a touch panel or may include a separate recognition sheet. The key 156 may include, for example, a physical button, optical key, or key pad. The ultrasonic input device 158 may detect ultrasonic waves generated in an input device through a microphone to determine data corresponding to the detected ultrasonic waves.

The display 160 may include a panel 162, hologram device 164, projector 166, and/or control circuit for controlling them. The panel 162 may be implemented with, for example, a flexible, transparent, or wearable method. The panel 162 and the touch panel 152 may be configured in at least one module. According to an embodiment, the panel 162 may include a pressure sensor (or a force sensor) that can measure pressure intensity of a user touch. The pressure sensor may be integrally implemented with the touch panel 152 or may be implemented with at least one sensor separate from the touch panel 152. The hologram device 164 may show a stereoscopic image in the air using interference of light. The projector 166 may project light on a screen to display an image. The screen may be positioned, for example, at the inside or the outside of the electronic device 101.

Figure 3:
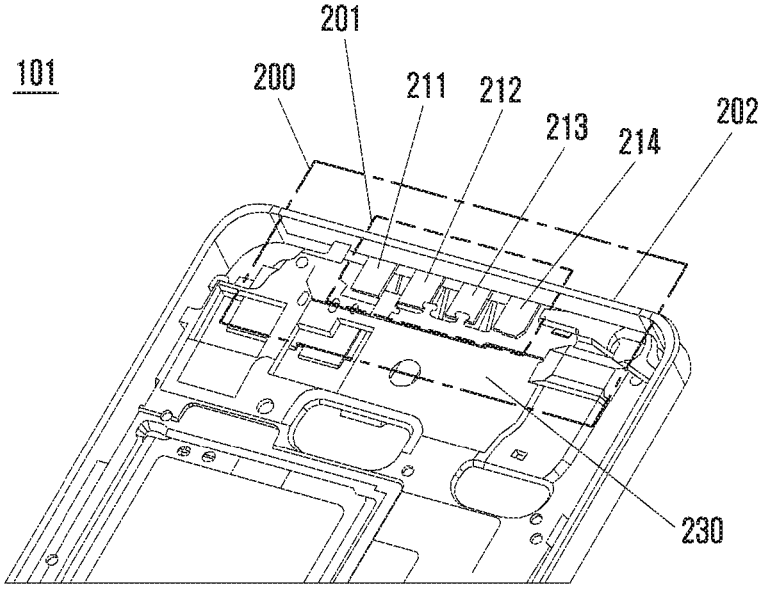
FIG. 3 is a front perspective view illustrating an electronic device according to various embodiments of the present disclosure.

FIG. 3 is a front perspective view illustrating an electronic device 101 according to various embodiments of the present disclosure.

Referring to FIG. 3, the electronic device 101 may include an antenna device 200. The antenna device 200 may include a frame 202, slot antenna 201, and circuit board 230. For antenna radiation efficiency, the frame 202 may be made of a material (e.g., metal) having small specific resistance. With reference to FIG. 3, the slot antenna 201 may include at least one vertical polarization tapered slot antenna 211, 212, 213, and 214. The circuit board 230 may be a circuit board of a single layer. In various embodiments, the circuit board 230 may be a multiple layer circuit board in which at least one circuit board is layered. The circuit board 230 may be a printed circuit board (PCB).

The vertical polarization tapered slot antennas 211, 212, 213, and 214 may efficiently transmit and receive vertically polarized waves among electric waves that may be transmitted and received by the electronic device 101. The vertical polarization tapered slot antennas 211, 212, 213, and 214 may transmit and receive horizontally polarized waves as well as vertically polarized waves of electric waves. The slot antenna may be an antenna having directivity.

The slot antenna is a kind of an aperture antenna and may directly radiate or receive electric waves through a slot.

It is characterized that the tapered slot antenna has an endless bandwidth, but a tapered slot antenna described in this specification may transmit a limited bandwidth (e.g., mmWave band) through a structure design.

Figure 4:
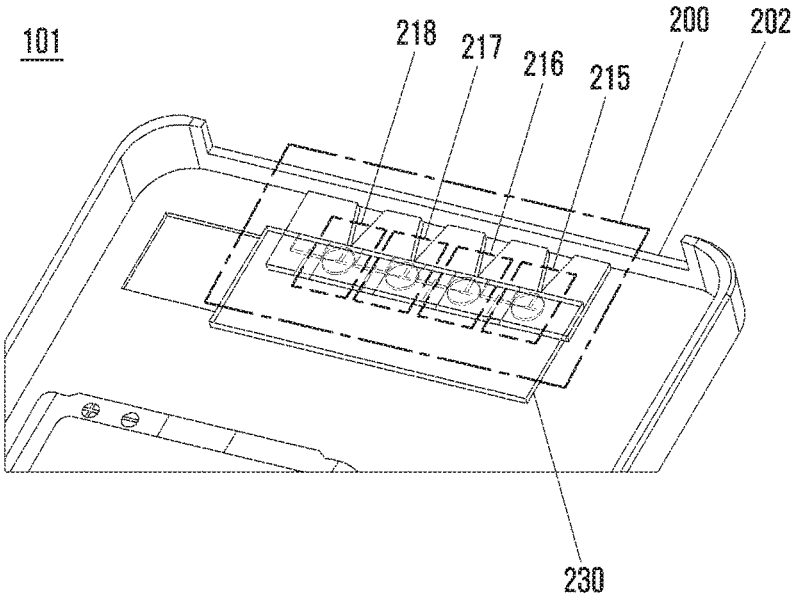
FIG. 4 is a rear perspective view illustrating an electronic device according to various embodiments of the present disclosure.

FIG. 4 is a rear perspective view illustrating an electronic device 101 according to various embodiments of the present disclosure.

Referring to FIG. 4, the electronic device 101 may include an antenna device 200. The antenna device 200 may include a frame 202, slot antenna 201, and circuit board 230. The frame 202 may be made of a material (e.g., metal) having small specific resistance for antenna radiation efficiency. With reference to FIG. 4, the slot antenna 201 may include at least one horizontal polarization tapered slot antenna 215, 216, 217, and 218.

The horizontal polarization tapered slot antennas 215, 216, 217, and 218 may efficiently transmit and receive horizontally polarized waves among electric waves that may be transmitted and received by the electronic device 101. The horizontal polarization tapered slot antennas 215, 216, 217, and 218 may transmit and receive vertically polarized waves as well as horizontally polarized waves of electric waves.

Figure 5:
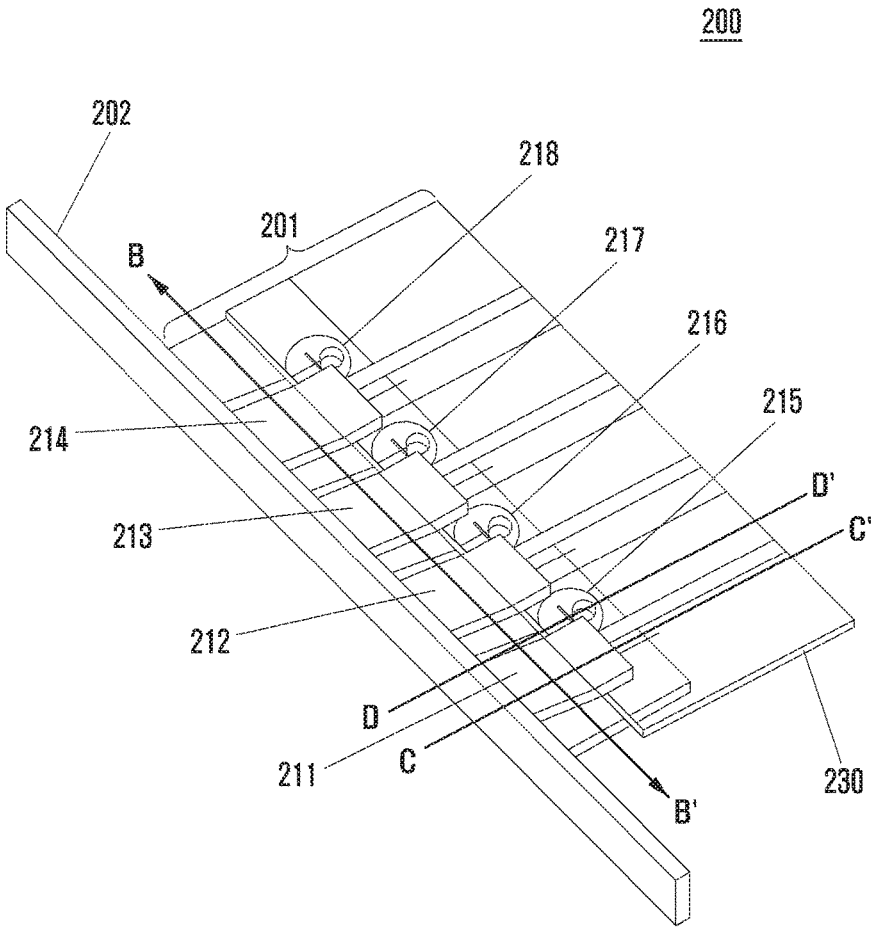
FIG. 5 is a perspective view illustrating an antenna device according to various embodiments of the present disclosure.

FIG. 5 is a perspective view illustrating an antenna device 200 according to various embodiments of the present disclosure.

Referring to FIG. 5, the antenna device 200 may include at least one vertical polarization tapered slot antennas 211, 212, 213, and 214, at least one horizontal polarization tapered slot antennas 215, 216, 217, and 218, a frame 202, and a circuit board 230.

At least a portion of the at least one vertical polarization tapered slot antennas 211, 212, 213, and 214 and the at least one horizontal polarization tapered slot antennas 215, 216, 217, and 218 may be connected to the frame 202.

The at least one vertical polarization tapered slot antennas 211, 212, 213, and 214 and the at least one horizontal polarization tapered slot antennas 215, 216, 217, and 218 may be disposed to intersect. For example, in the antenna device 200, the horizontal polarization tapered slot antenna may be disposed following the vertical polarization tapered slot antenna, and the vertical polarization tapered slot antenna may be disposed following the horizontal polarization tapered slot antenna.

In the antenna device 200, the first horizontal polarization tapered slot antenna 215 may be disposed between the first vertical polarization tapered slot antenna 211 and the second vertical polarization tapered slot antenna 212. The second horizontal polarization tapered slot antenna 216 may be disposed between the second vertical polarization tapered slot antenna 212 and the third vertical polarization tapered slot antenna 213. The third horizontal polarization tapered slot antenna 217 may be disposed between the third vertical polarization tapered slot antenna 213 and the fourth vertical tapered slot antenna 214. The second vertical polarization tapered slot antenna 212 may be disposed between the first horizontal polarization tapered slot antenna 215 and the second horizontal polarization tapered slot antenna 216. The third vertical polarization tapered slot antenna 213 may be disposed between the second horizontal polarization tapered slot antenna 216 and the third horizontal polarization tapered slot antenna 217. The fourth vertical polarization tapered slot antenna 214 may be disposed between the third horizontal polarization tapered slot antenna 217 and the fourth horizontal polarization tapered slot antenna 218.

At one surface (e.g., a first surface) of the circuit board 230, a portion of at least one horizontal polarization tapered slot antenna 215, 216, 217, and 218 and at least one vertical polarization tapered antenna 211, 212, 213, and 214 may be disposed. At the other surface (e.g., a second surface) of the circuit board 230, a portion of at least one vertical polarization tapered antenna 211, 212, 213, and 214 may be disposed. Portions of at least one vertical polarization tapered antenna 211, 212, 213, and 214 disposed at one surface (e.g., first surface) of the circuit board 230 and at least one vertical polarization tapered antenna 211, 212, 213, and 214 disposed at the other surface (e.g., second surface) thereof may be separated from each other to form a slot.

Figure 6:
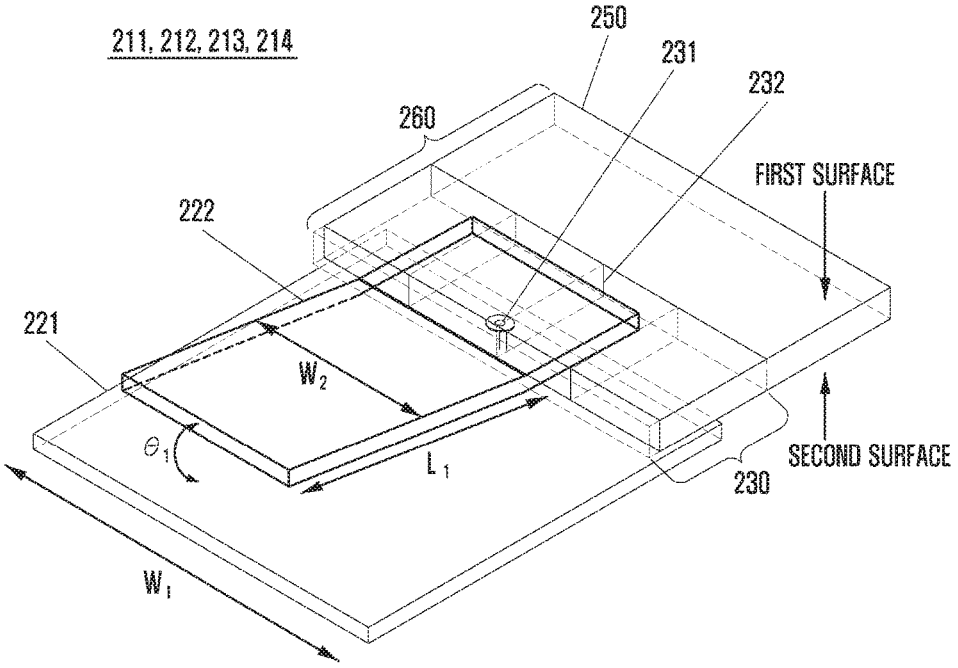
FIG. 6 is a diagram illustrating a structure of a vertical polarization tapered slot antenna according to various embodiments of the present disclosure.

FIG. 6 is a diagram illustrating a structure of the vertical polarization tapered slot antennas 211, 212, 213, and 214 according to various embodiments of the present disclosure.

Referring to FIG. 6, in the vertical polarization tapered slot antennas 211, 212, 213, and 214, a first metal plate 221, which is a portion of the vertical polarization tapered slot antennas 211, 212, 213, and 214 may be coupled to a portion of a first surface of the circuit board 230. At least a portion of the first metal plate 221 may be fixed to the circuit board 230. A width of the first metal plate 221 may be a first width W1. A width direction of the first metal plate 221 may be a horizontal direction of the circuit board 230. A second metal plate 222, which is a portion of the vertical polarization tapered slot antennas 211, 212, 213, and 214 may be coupled to a portion of a second surface of the circuit board 230. At least a portion of the second metal plate 222 may be coupled to the frame 202. In various embodiments, at least a portion of the second metal plate 222 may be electrically connected to the frame 202. A width of the second metal plate 222 may be a second width W2. A width direction of the second metal plate 222 may be a horizontal direction of the circuit board 230. The second metal plate 222 may have a first length L1. A length direction of the second metal plate 222 may be a vertical direction of the circuit board 230.

The first metal plate 221 and the second metal plate 222 may be separated by a first angle θ1. A separation distance between the first metal plate 221 and the second metal plate 222 may be largest at the frame 202 side and may be smallest at the circuit board 230 side. A separation distance between the first metal plate 221 and the second metal plate 222 may decrease in a tapered form as advancing from the frame 202 side to the circuit board 230 side. The vertical polarization tapered slot antennas 211, 212, 213, and 214 according to various embodiments of the present disclosure may have a three-dimensional structure using the first metal plate 221 and the second metal plate 222. A separation distance between the first metal plate 221 and the second metal plate 222 of the vertical polarization tapered slot antennas 211, 212, 213, and 214 may decrease in a tapered form as a distance from an aperture increases. A separation distance between the first metal plate 221 and the second metal plate 222 of the vertical polarization tapered slot antennas 211, 212, 213, and 214 may decrease as a distance from an aperture increases while forming a specific angle θ1.

In a separation space of the first metal plate 221 and the second metal plate 222, a dielectric substance may be filled. In this specification, a dielectric substance filled in a separation space of the first metal plate 221 and the second metal plate 222 may be air.

When a first width W1 and a second width W2 increase, a gain of the vertical polarization tapered slot antennas 211, 212, 213, and 214 may increase.

When a first length L1 increases, a resonant frequency of the vertical polarization tapered slot antennas 211, 212, 213, and 214 may be lowered.

When a first angle θ1, which is a separation angle between the first metal plate 221 and the second metal plate 222 increases, a resonant frequency of the vertical polarization tapered slot antennas 211, 212, 213, and 214 may be lowered, and a bandwidth of the vertical polarization tapered slot antennas 211, 212, 213, and 214 may increase. The first angle θ1 may be formed by bending of the second metal plate 222 without bending of the first metal plate 221.

In a feed structure 260 of the vertical polarization tapered slot antennas 211, 212, 213, and 214, the first metal plate 221 and the second metal plate 222 may be connected through a first feed terminal 231 and may be connected to the circuit board 230 through a second feed terminal 232 connected to the first feed terminal 231. Electric waves received by the vertical polarization tapered slot antennas 211, 212, 213, and 214 may be transferred to a front end module (FEM) 250 disposed at the circuit board 230 through the first feed terminal 231 and the second feed terminal 232. The electronic device 101 may supply power through the first feed terminal 231 and the second feed terminal 232 such that the vertical polarization tapered slot antennas 211, 212, 213, and 214 radiate electric waves.

Figure 7A:
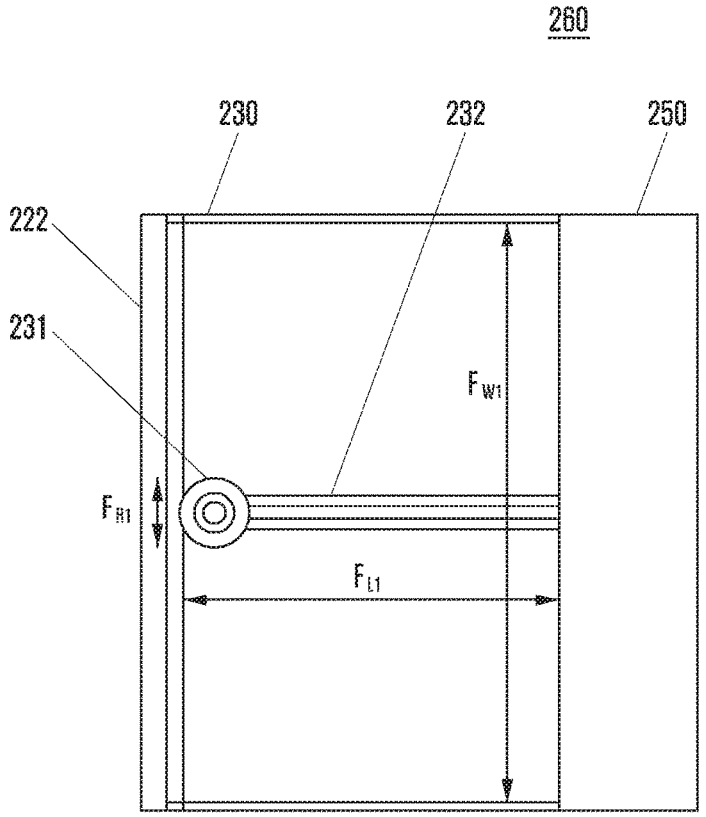
FIGS. 7A and 7B are diagrams illustrating a feed structure of a vertical polarization tapered slot antenna disposed at a circuit board according to various embodiments of the present disclosure.
Figure 7B:
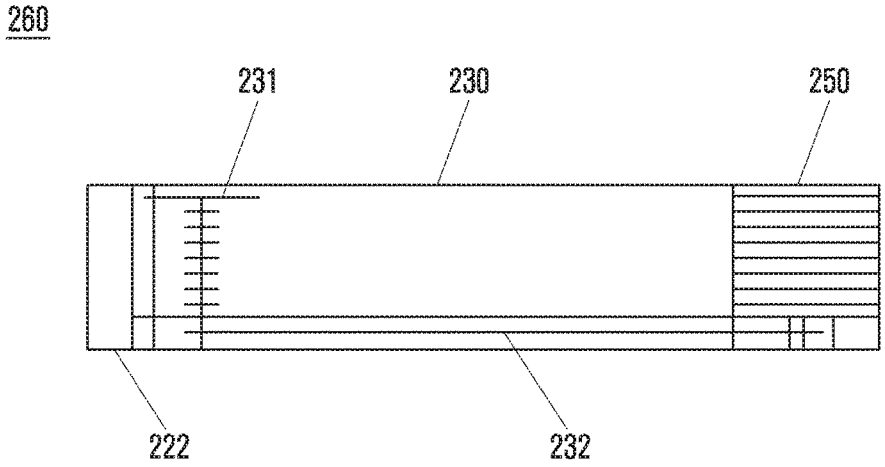

FIGS. 7A and 7B are diagrams illustrating a feed structure 260 of vertical polarization tapered slot antennas 211, 212, 213, and 214 disposed at a circuit board 230 according to various embodiments of the present disclosure.

FIG. 7A is a diagram illustrating the feed structure 260 of the vertical polarization tapered slot antennas 211, 212, 213, and 214 disposed at the circuit board 230 viewed from a front surface of the circuit board 230, and FIG. 7B is a diagram illustrating the feed structure 260 of the vertical polarization tapered slot antennas 211, 212, 213, and 214 disposed at the circuit board 230 viewed from a side surface of the circuit board 230.

With reference to FIGS. 7A and 7B, the first feed terminal 231 may have a circular structure, and the first feed terminal 231 may have a circular structure having a first feed diameter FR1. The second feed terminal 232 may have a feed line structure. The second feed terminal 232 may have a first feed length FL1. The feed structure 260 of the vertical polarization tapered slot antennas 211, 212, 213, and 214 may have a first feed width Fw1 corresponding to a second width W2 of the vertical polarization tapered slot antennas 211, 212, 213, and 214. A resonant frequency and a bandwidth of the vertical polarization tapered slot antennas 211, 212, 213, and 214 may increase in proportion to the first feed diameter FR1 and the first feed length FL1. When the first feed width Fw1 increases, a resonant frequency of the vertical polarization tapered slot antennas 211, 212, 213, and 214 may reduce. The second feed terminal 232 may electrically connect the first feed terminal 231 and the front end module 250. The front end module 250 may electrically connect the antenna device 200 and the communication module 120 to perform amplification of an RF signal and operation of a tuner and a mixer.

Figure 8:
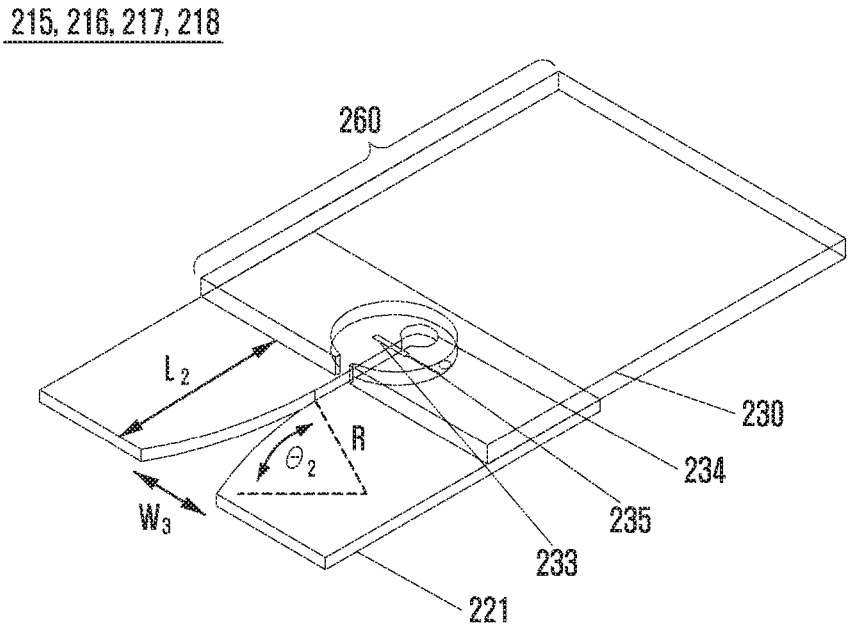
FIG. 8 is a diagram illustrating a structure of a horizontal polarization tapered slot antenna according to various embodiments of the present disclosure.

FIG. 8 is a diagram illustrating a structure of horizontal polarization tapered slot antennas 215, 216, 217, and 218 according to various embodiments of the present disclosure.

Referring to FIG. 8, the horizontal polarization tapered slot antennas 215, 216, 217, and 218 may include a first metal plate 221 in a portion of a first surface of the circuit board 230. A partial area of the first metal plate 221 may have a plane tapered slot antenna form, and a plane slot may have a form that increases in a direction of the frame 202 and that decreases in a direction of the circuit board 230. The first metal plate 221 constituting a portion of the horizontal polarization tapered slot antennas 215, 216, 217, and 218 may be extended to be connected to a portion of the first metal plate 221 of the vertical polarization tapered slot antennas 211, 212, 213, and 214. That is, a partial area of the first metal plate 221 may be used as the vertical polarization tapered slot antennas 211, 212, 213, and 214, and another partial area of the first metal plate 221 may be used as the horizontal polarization tapered slot antennas 215, 216, 217, and 218.

When the first metal plate 221 is used as the horizontal polarization tapered slot antennas 215, 216, 217, and 218, the first metal plate 221 does not form a structure with the second metal plate 222, and the horizontal polarization tapered slot antennas 215, 216, 217, and 218 may have a two-dimensional plane shape in which a partial area of the first metal plate 221 is processed to have a tapered structure. The horizontal polarization tapered slot antennas 215, 216, 217, and 218 may have a plate-shaped tapered structure having a reducing slot size as receded from an opening line. A dielectric substance may be filled in an opening of the horizontal polarization tapered slot antennas 215, 216, 217, and 218. In this specification, a dielectric substance filled in the tapered slot of the first metal plate 221 may be air. Because a slot size reduces as receded from an opening line, the horizontal polarization tapered slot antennas 215, 216, 217, and 218 may reduce while forming a specific angle θ2. A specific angle θ2 may be a specific angle from a start point of an opening of the horizontal polarization tapered slot antennas 215, 216, 217, and 218 to the circuit board 230 based on a random radius Ron the first metal plate 221.

In the horizontal polarization tapered slot antennas 215, 216, 217, and 218 formed in a partial area of the first metal plate 221, a width of a portion adjacent to the frame 202 may be a third width W3. The horizontal polarization tapered slot antennas 215, 216, 217, and 218 formed in a partial area of the first metal plate 221 may have a second length L2.

The third width W3 of the horizontal polarization tapered slot antennas 215, 216, 217, and 218 formed in a partial area of the first metal plate 221 may reduce as advancing to the circuit board 230 and reduce while having a second angle θ2.

When the third width W3 increases, a gain of the horizontal polarization tapered slot antennas 215, 216, 217, and 218 may reduce. When the second length L2 increases, a resonant frequency of the horizontal polarization tapered slot antennas 215, 216, 217, and 218 may reduce. When the second angle θ2 increases, a resonant frequency of the horizontal polarization tapered slot antennas 215, 216, 217, and 218 may reduce and a bandwidth thereof may increase.

The feed structure 260 of the horizontal polarization tapered slot antennas 215, 216, 217, and 218 may include a third feed terminal 233 connected to the circuit board 230, and a circular fourth feed terminal 234 and a feed line 235 at an end portion of a tapered structure.

Figure 9:
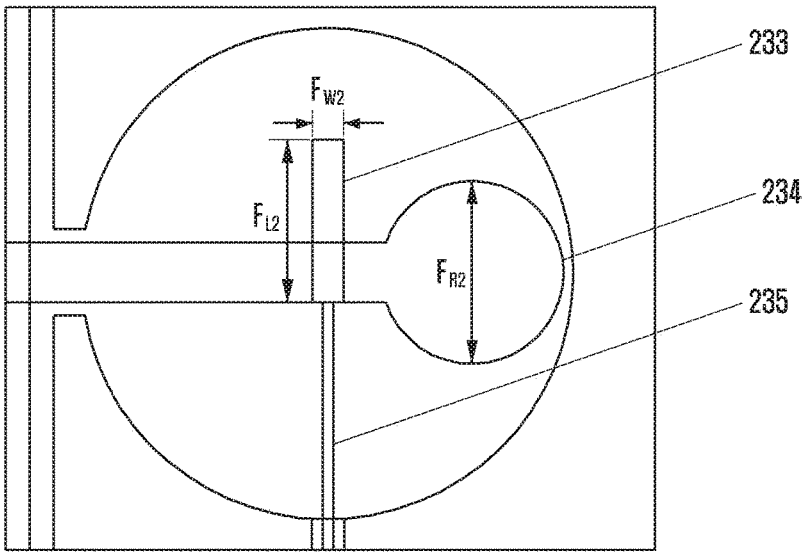
FIG. 9 is a diagram illustrating a feed structure of a horizontal polarization tapered slot antenna according to various embodiments of the present disclosure.

FIG. 9 is a diagram illustrating a feed structure 260 of horizontal polarization tapered slot antennas 215, 216, 217, and 218 according to various embodiments of the present disclosure.

Referring to FIG. 9, the third feed terminal 233 is a rectangle having a second feed width Fw2 and a second feed length FL2 and may be disposed at a front portion of the fourth feed terminal 234. The third feed terminal 233 may be connected to the feed line 235 to transmit and receive electric waves.

The fourth feed terminal 234 may be formed in a circle at an end portion of a tapered structure and may have a second feed diameter FR2. A resonant frequency and a bandwidth of the horizontal polarization tapered slot antennas 215, 216, 217, and 218 may increase in proportion to the second feed width Fw2, the second feed length FL2, and the second feed diameter FR2.

Figure 10:
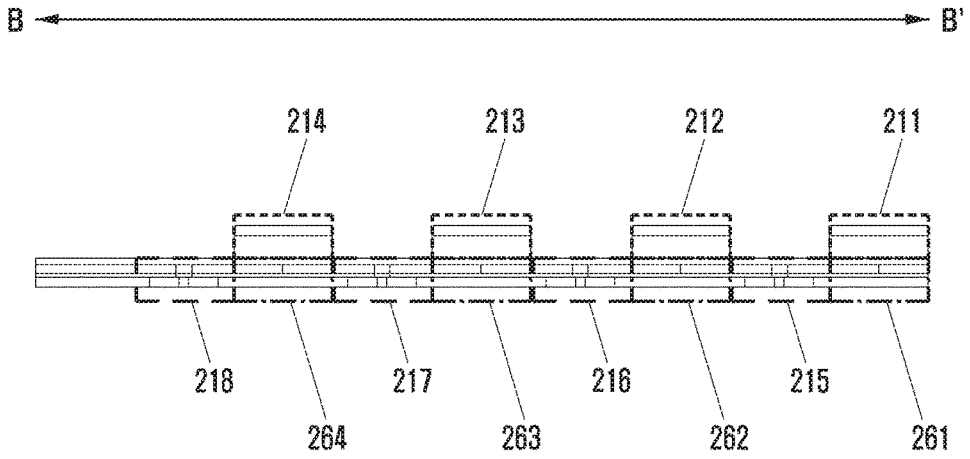
FIG. 10 is a cross-sectional view illustrating the antenna device taken along line B-B' of FIG. 5 according to various embodiments of the present disclosure.

FIG. 10 is a cross-sectional view illustrating the antenna device 200 taken along line B-B' of FIG. 5 according to various embodiments of the present disclosure.

Referring to FIG. 10, at least one vertical polarization tapered slot antenna 211, 212, 213, and 214 and at least one horizontal polarization tapered slot antenna 215, 216, 217, and 218 may be disposed to intersect. For example, in the antenna device 200, the horizontal polarization tapered slot antenna may be disposed following the vertical polarization tapered slot antenna, and the vertical polarization tapered slot antenna may be disposed following the horizontal polarization tapered slot antenna.

In the antenna device 200, the first horizontal polarization tapered slot antenna 215 may be disposed between the first vertical polarization tapered slot antenna 211 and the second vertical polarization tapered slot antenna 212. The second horizontal polarization tapered slot antenna 216 may be disposed between the second vertical polarization tapered slot antenna 212 and the third vertical polarization tapered slot antenna 213. The third horizontal polarization tapered slot antenna 217 may be disposed between the third vertical polarization tapered slot antenna 213 and the fourth vertical tapered slot antenna 214. The second vertical polarization tapered slot antenna 212 may be disposed between the first horizontal polarization tapered slot antenna 215 and the second horizontal polarization tapered slot antenna 216. The third vertical polarization tapered slot antenna 213 may be disposed between the second horizontal polarization tapered slot antenna 216 and the third horizontal polarization tapered slot antenna 217. The fourth vertical polarization tapered slot antenna 214 may be disposed between the third horizontal polarization tapered slot antenna 217 and the fourth horizontal polarization tapered slot antenna 218. A first ground 261 may be disposed at the low end of the first vertical polarization tapered slot antenna 211, a second ground 262 may be disposed at the low end of the second vertical polarization tapered slot antenna 212, a third ground 263 may be disposed at the low end of the third vertical polarization tapered slot antenna 213, and a fourth ground 264 may be disposed at the low end of the fourth vertical polarization tapered slot antenna 214. The first horizontal polarization tapered slot antenna 215 may be disposed between the first ground 261 and the second ground 262, the second horizontal polarization tapered slot antenna 216 may be disposed between the second ground 262 and the third ground 263, the third horizontal polarization tapered slot antenna 217 may be disposed between the third ground 263 and the fourth ground 264, and the fourth ground 264 may be disposed between the third horizontal polarization tapered slot antenna 217 and the fourth horizontal polarization tapered slot antenna 218. At least one horizontal polarization tapered slot antenna 215, 216, 217, and 218 and at least one vertical polarization tapered slot antenna 211, 212, 213, and 214 have a height difference, but at least one horizontal polarization tapered slot antennas 215, 216, 217, and 218 and at least one ground 261, 262, 263, 264 may be connected and disposed without a height difference.

Figure 11A:
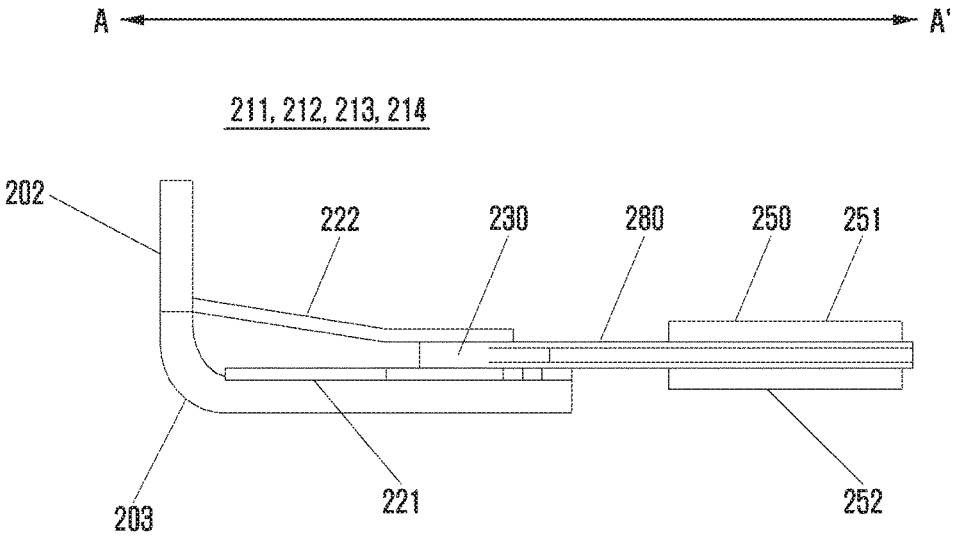
FIGS. 11A and 11B are cross-sectional views illustrating the electronic device taken along line A-A' of FIG. 1 according to various embodiments of the present disclosure.
Figure 11B:
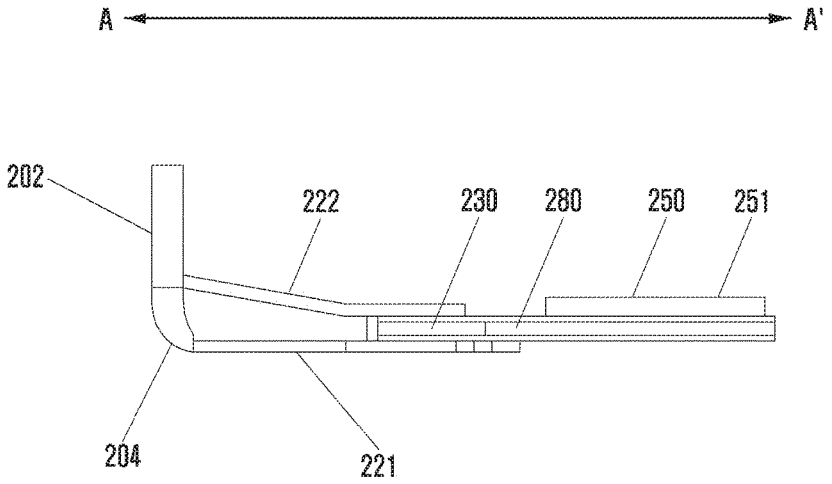

FIGS. 11A and 11B are cross-sectional views illustrating the electronic device 101 taken along line A-A' of FIG. 1 according to an embodiment of the present disclosure.

FIG. 11A illustrates a case in which the cover 180 is an insulator 203, and FIG. 11B illustrates a case in which the cover 180 is configured with the first metal plate 221.

Referring to FIG. 11A, the first metal plate 221 may be disposed on the insulator 203 and may form a space with separated from the second metal plate 222 coupled to the frame 202. The circuit board 230 may be coupled to a partial area of the first metal plate 221 and the second metal plate 222, the circuit board 230 may be disposed at an upper portion of the first metal plate 221, and the second metal plate 222 may be coupled to an upper portion of the circuit board 230. The insulator 203 and the frame 202 may configure a portion of the housing of the electronic device 101. The insulator 203 prevents the frame 202 and the second metal plate 222 from being electrically connected to the first metal plate 221. The circuit board 230 may connect the front end module 250 disposed at the circuit board 230 through the feed line 280 and the first metal plate 221 and the second metal plate 222. The front end module 250 may include a first front end module 251 disposed in a direction of the display 160, i.e., a front direction of the electronic device 101 and a second front end module 252 disposed in a direction of the cover 180, i.e., a back direction of the electronic device 101.

Referring to FIG. 11B, when the cover 180 is configured with the first metal plate 221, the first metal plate 221 may configure a housing of the electronic device 101 together with the frame 202 and an insulator 204. The circuit board 230 may be coupled to a partial area of the first metal plate 221 and the second metal plate 222, the circuit board 230 may be disposed at an upper portion of the first metal plate 221, and the second metal plate 222 may be coupled to an upper portion of the circuit board 230. The insulator 204 prevents the frame 202 and the second metal plate 222 from being electrically connected to the first metal plate 221. The circuit board 230 may connect the front end module 250 disposed at the circuit board 230 through the feed line 280 and the first metal plate 221 and the second metal plate 222. The front end module 250 may be disposed in a direction of the display 160, i.e., a front direction of the electronic device 101.

Figure 12:
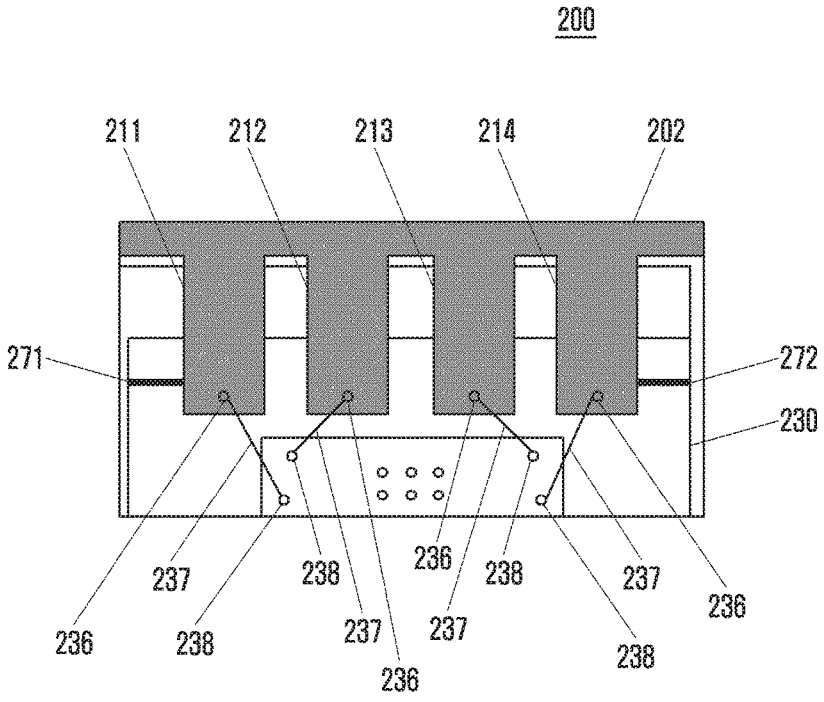
FIG. 12 is a diagram illustrating an antenna device viewed from a front surface of an electronic device according to various embodiments of the present disclosure.

FIG. 12 is a diagram illustrating an antenna device 200 viewed from a front surface of an electronic device 101 according to various embodiments of the present disclosure.

Referring to FIG. 12, in the antenna device 200, the frame 202 and at least one vertical polarization tapered slot antennas 211, 212, 213, and 214 may be coupled, and the vertical polarization tapered slot antennas 211, 212, 213, and 214 and the horizontal polarization tapered slot antennas 215, 216, 217, and 218 may be connected to a feed terminal 236 disposed at the tapered slot antenna through the feed line 237 and a feed terminal 238 disposed at the circuit board 230. The second metal plate 222 of the first vertical polarization tapered slot antenna 211 may be connected to the circuit board 230 through the first feed line 271, and the second metal plate 222 of the fourth vertical polarization tapered slot antenna 214 may be connected to the front end module 250 connected to the circuit board 230 through the second feed line 272.

Figure 13:
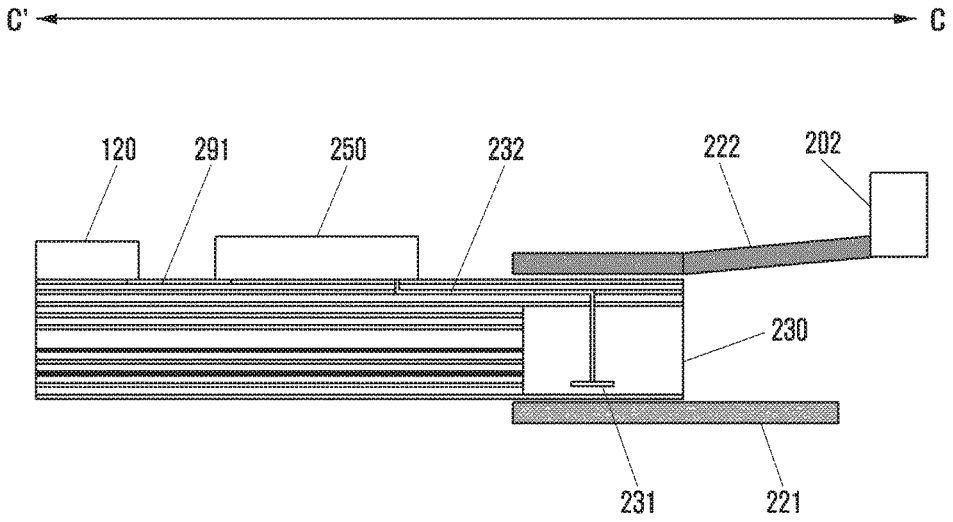
FIG. 13 is a cross-sectional view illustrating the antenna device taken along line C-C' of FIG. 5 according to various embodiments of the present disclosure.

FIG. 13 is a cross-sectional view illustrating the antenna device 200 taken along line C-C' of FIG. 5 according to an embodiment of the present disclosure.

FIG. 13 illustrates the antenna device 200 taken along line C-C' of FIG. 5 and is a cross-sectional view illustrating the first vertical polarization tapered slot antenna 211.

Referring to FIG. 13, the circuit board 230 is disposed between the first metal plate 221 and the second metal plate 222. The first metal plate 221 is connected to the frame 202. The first vertical polarization tapered slot antenna 211 may be connected to the front end module 250 through the first feed terminal 231 and the second feed terminal 232. The front end module 250 may be connected to the communication module 120 through a feed line 291.

Figure 14:
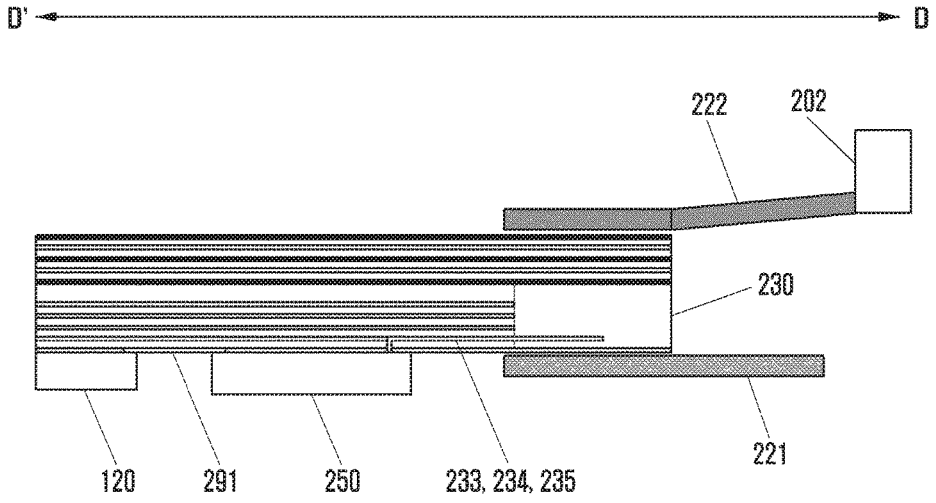
FIG. 14 is a cross-sectional view illustrating the antenna device taken along line of FIG. 5.

FIG. 14 is a cross-sectional view illustrating the antenna device 200 taken along line of FIG. 5 according to various embodiments of the present disclosure.

FIG. 14 illustrates the antenna device 200 taken along line of FIG. 5 and is a cross-sectional view illustrating the first horizontal polarization tapered slot antenna 215.

Referring to FIG. 14, the circuit board 230 is disposed between the first metal plate 221 and the second metal plate 222. The first metal plate 222 is connected to the frame 202. The first vertical polarization tapered slot antenna 211 may be connected to the front end module 250 through the third feed terminal 233, the fourth feed terminal 234, and the feed line 235. The front end module 250 may be connected to the communication module 120 through the feed line 291.

Figure 15:
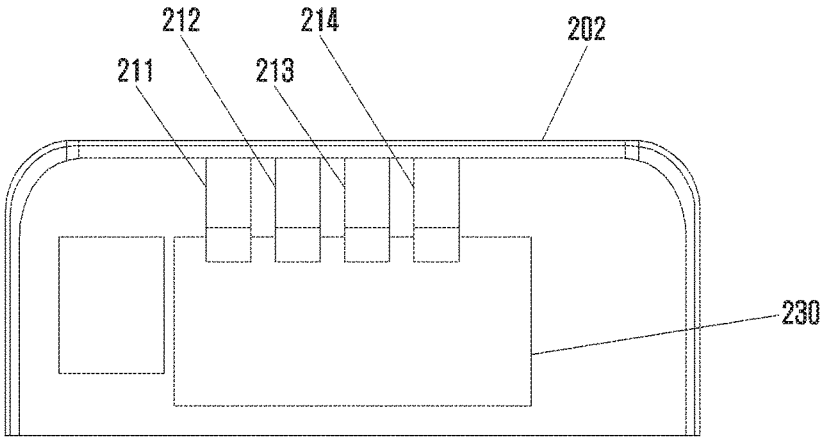
FIG. 15 is a diagram illustrating 4G band electric wave transmission and reception using an antenna device according to various embodiments of the present disclosure.

FIG. 15 is a diagram illustrating 4G band electric wave transmission and reception using an antenna device 200 according to various embodiments of the present disclosure.

In various embodiments, the antenna device 200 may radiate or receive a frequency of a 4G band using at least a portion of the vertical polarization tapered slot antennas 211, 212, 213, and 214 as feeding or the ground.

Referring to FIG. 15, the electronic device 101 may radiate a first band of frequency (e.g., mmWave) through the band tapered slot antenna 201 in response to a first feed signal under the control of the communication module 120. The electronic device 101 may receive a first band of frequency (e.g., mmWave band) through the tapered slot antenna 201. The first feed signal may include energy corresponding to a first band of frequency.

When transmitting and receiving a first band of frequency, the vertical polarization tapered slot antennas 211, 212, 213, and 214 may transmit and receive vertically polarized waves of a first band frequency.

When transmitting and receiving a first band of frequency, the horizontal polarization tapered slot antennas 215, 216, 217, and 218 may transmit and receive horizontally polarized waves of a first band frequency.

The electronic device 101 may radiate a second band of frequency (e.g., 4G band) through the tapered slot antenna 201 in response to a second feed signal under the control of the communication module 120. The electronic device 101 may receive a second band of frequency (e.g., 4G band) through the tapered slot antenna 201. The second feed signal may include energy corresponding to a second band of frequency.

When transmitting and receiving a second band of frequency, the electronic device 101 may use at least a portion of the vertical polarization tapered slot antennas 211, 212, 213, and 214 as feeding or the ground.

Figure 16:
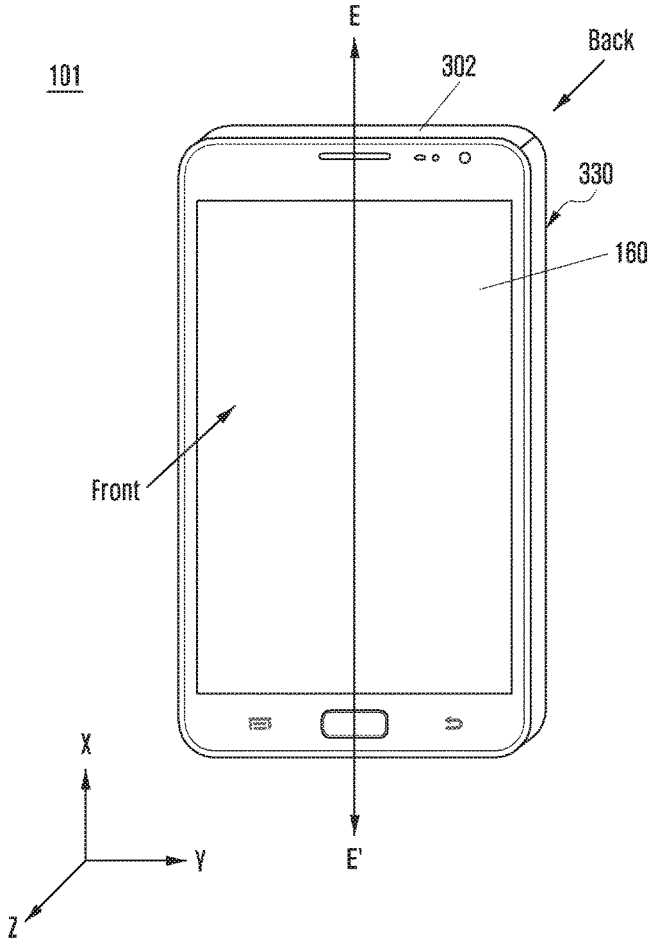
FIG. 16 is a perspective view illustrating an electronic device according to various embodiments of the present disclosure.

FIG. 16 is a perspective view illustrating an electronic device 101 according to various embodiments of the present disclosure.

Referring to FIG. 16, the electronic device 101 may include a display 160 that exposes at least a portion of an external shape in a front direction and include a cover 330 in a back direction. A front surface of the electronic device 101 may have a shape of substantially a rectangle or a square. The electronic device 101 may mount a component or a circuit (e.g., antenna device, processor, PCB, memory, communication module) necessary for operation of the electronic device 101 at a space between a front surface and a rear surface. The electronic device 101 may include a frame 302 that encloses a space between the front surface and the rear surface to protect an internal space of the electronic device 101. The electronic device 101 may configure an external shape with the display 160, the cover 330, and the frame 302 and may be substantially a cuboid. The cover 330 may be made of an insulator (or a dielectric substance) or a metal material. The frame 302 may be made of an insulator (or a dielectric substance) or a metal material.

Figure 17:
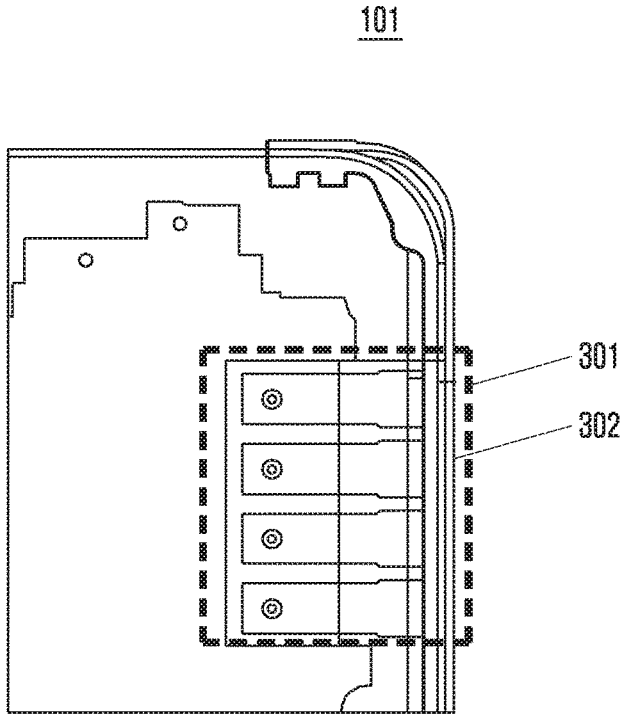
FIG. 17 is a front perspective view illustrating an electronic device according to various embodiments of the present disclosure.

FIG. 17 is a front perspective view illustrating an electronic device 101 according to various embodiments of the present disclosure.

Referring to FIG. 17, the electronic device 101 may include an antenna device 301 coupled to a frame 302. The antenna device 301 may include at least one waveguide antenna.

Figure 18:
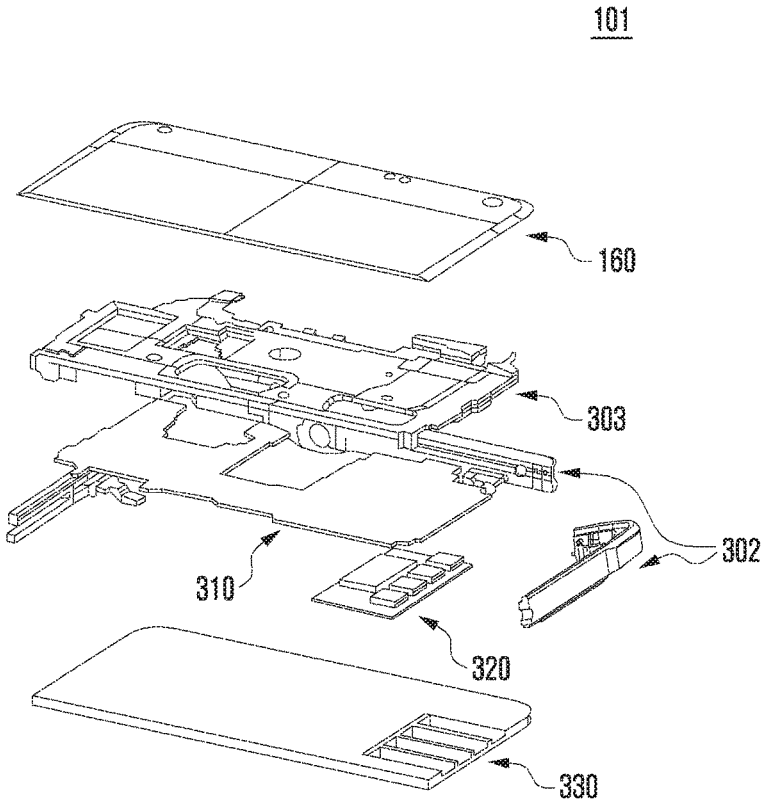
FIG. 18 is an exploded perspective view illustrating an electronic device according to various embodiments of the present disclosure.

FIG. 18 is an exploded perspective view illustrating an electronic device 101 according to various embodiments of the present disclosure.

Referring to FIG. 18, the electronic device 101 forms a space between the display 160 and the cover 330 forming an external shape, and the frame 302 encloses the space. A space between the display 160 and the cover 330 of the electronic device 101 may include at least one circuit board 310 and 320 and include an internal frame 303.

Figure 19:
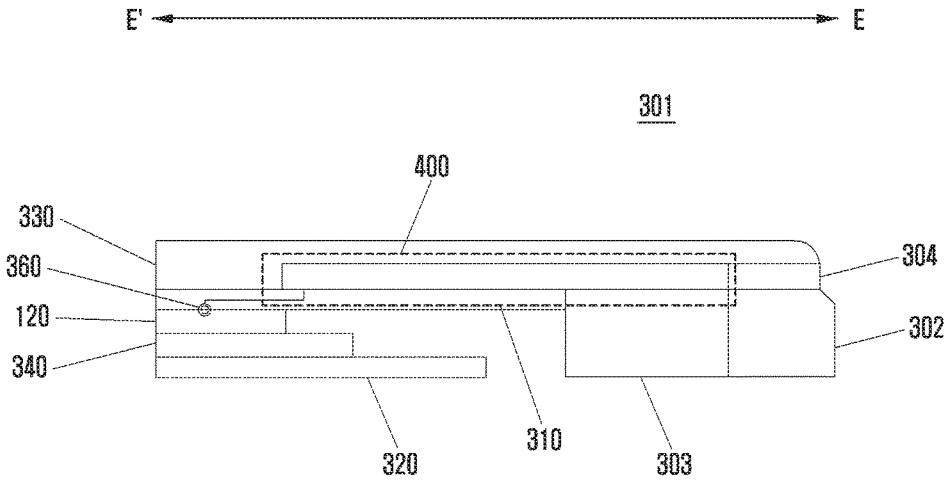
FIG. 19 is a cross-sectional view illustrating the electronic device taken along line E-E' of FIG. 16 according to various embodiments of the present disclosure.

FIG. 19 is a cross-sectional view illustrating the electronic device 101 taken along line E-E' of FIG. 16 according to an embodiment of the present disclosure.

Referring to FIG. 19, the antenna device 301 may include a frame 302, internal frame 303, insulator 304, at least one circuit board 310 and 320, cover 330, heat radiating unit 340, communication module 120, and feed terminal 360.

In order to form a waveguide antenna 400, a partial area of the cover 330 may be processed. A partial area of the cover 330 may be processed to have a small thickness such that the cover 330 may couple to the first circuit board 310, the frame 302, the internal frame 303, and the insulator 304 to form a cavity. A partial area of the cover 330 may be coupled to the first circuit board 310, and the first circuit board 310 may be electrically connected to the communication module 120 through the waveguide antenna 400 and the feed terminal 360. The first circuit board 310 may be disposed between the cover 330 and the communication module 120, and the heat radiating unit 340 may be disposed between the communication module 120 and the second circuit board 320. The frame 302, the internal frame 303 and the first circuit board 310 may be flatly disposed without a step to form one area of the waveguide antenna 400. The insulator 304 may be disposed between the frame 302 and the cover 330. The waveguide antenna 400 may have a cross-sectional area of a rectangular shape.

Figure 20:
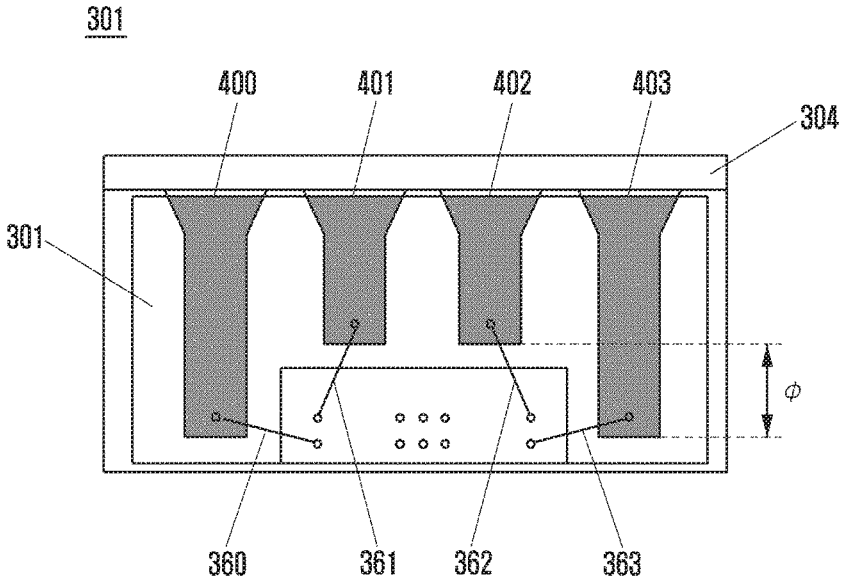
FIG. 20 is a front perspective view illustrating an electronic device according to various embodiments of the present disclosure.

FIG. 20 is a front perspective view illustrating an electronic device 101 in which the display 160 is removed according to various embodiments of the present disclosure.

Referring to FIG. 20, the antenna device 301 may include at least one waveguide antenna 400, 401, 402, and 403, a first circuit board 310, and an insulator 304. The at least one waveguide antenna 400, 401, 402, and 403 may be formed by coupling to the cover 330, the first circuit board 310, and the insulator 304. The at least one waveguide antenna 400, 401, 402, and 403 may be electrically connected to the communication module 120 coupled to the first circuit board 310 through at least one feed terminal 360, 361, 362, and 363, respectively. The first waveguide antenna 400 and the fourth waveguide antenna 403 may be disposed at both side surfaces of the electronic device 101, and at the center thereof, the second waveguide antenna 401 and the third waveguide antenna 402 may be disposed. In a length of the waveguide antenna extended from the insulator 304, the first waveguide antenna 400 and the fourth waveguide antenna 403 may be longer than the second waveguide antenna 401 and the third waveguide antenna 402. The at least one waveguide antenna 400, 401, 402, and 403 included in the antenna device 301 may transmit and receive vertically polarized waves of electric waves.

Figure 21:
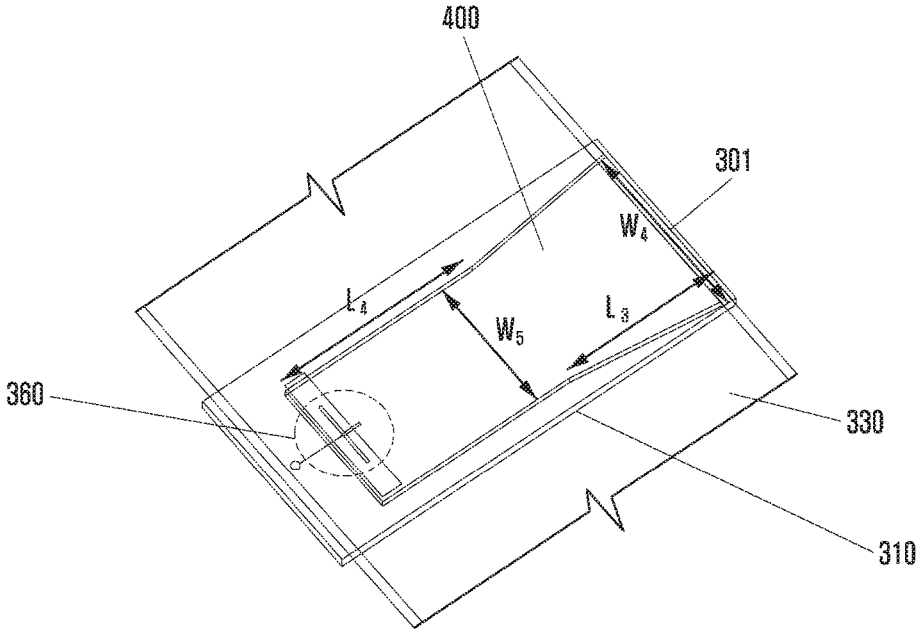
FIG. 21 is a diagram illustrating a waveguide antenna according to various embodiments of the present disclosure.

FIG. 21 is a diagram illustrating a waveguide antenna 400 according to various embodiments of the present disclosure.

Referring to FIG. 21, the waveguide antenna 400 may be formed by coupling to the cover 330, the first circuit board 310, and the insulator 304. The waveguide antenna 400 may have a structure that reduces in a horn shape as receded from the insulator 304. In the waveguide antenna 400, when a waveguide antenna width in a direction of the insulator 304 is a fourth width W4, a waveguide antenna width of a direction receded to the insulator 304 is a fifth width W5, and the fourth width W4 may be greater than the fifth width W5. A length of the waveguide antenna 400 from the fourth width W4 to the fifth width W5 is a third length L3, and a length of the waveguide antenna 400 from the fifth width W5 to the feed terminal 360 is a fourth length L4. There is no width change in the waveguide antenna 400 from the fifth width W5 to the feed terminal 360. A gain of the waveguide antenna 400 increases in proportion to the fourth width W4 and the third length L3, and a resonant frequency and a bandwidth of the waveguide antenna 400 increases in proportion to the fifth width W5 and the fourth length L4.

Figure 22:
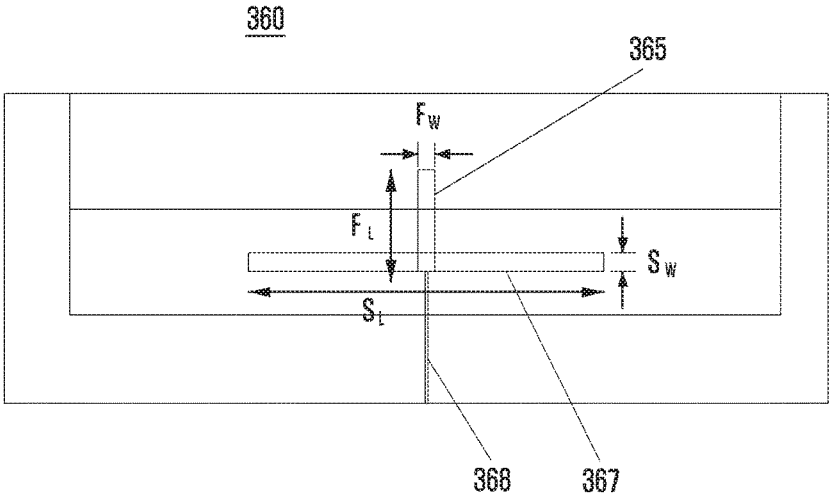
FIG. 22 is a diagram illustrating a feed terminal according to various embodiments of the present disclosure.

FIG. 22 is a diagram illustrating a feed terminal 360 according to various embodiments of the present disclosure.

The feed terminal 360 may be configured in a capital 'T' shape, and impedance may be determined according to a length and a thickness of the 'T-shaped feed terminal 360; thus, a resonant frequency and bandwidth of the waveguide antenna 400 may be changed. The feed terminal 360 may include a first feed portion 365, second feed portion 367, and feed line 368. The first feed portion 365 and the second feed portion 367 may be connected in a 'T' shape, and the first feed portion 365 may be vertically connected to a central portion of the second feed portion 367. A resonant frequency and a bandwidth of the waveguide antenna 400 may be determined according to a feeding width Fw and a feeding length FL of the first feed portion 365 and a feeding width SW and a feeding length SL of the second feed portion 367.

Figure 23:
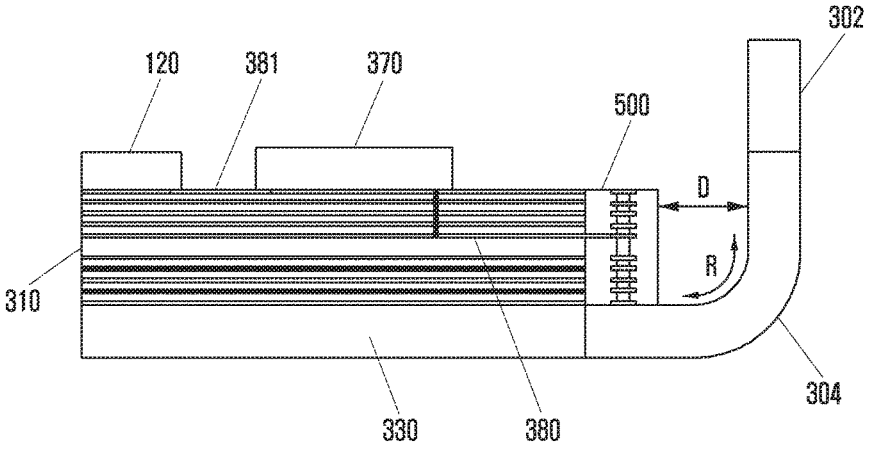
FIG. 23 is a diagram illustrating an antenna device of an electronic device according to various embodiments of the present disclosure.

FIG. 23 is a diagram illustrating the antenna device 301 of the electronic device 101 according to various embodiments of the present disclosure.

The antenna device 301 may include a patch antenna 500. The patch antenna 500 may be coupled to one side end of the first circuit board 310 and may be separated by a predetermined distance D from the insulator 304. A partial area of the insulator 304 may have a curve segment R. A separation distance D between the patch antenna 500 and the insulator 304 and a curve segment R of the insulator 304 are in a correlation to a gain and coverage of the patch antenna 500.

In the first circuit board 310, the patch antenna 500 and the front end module 370 may be connected by a feed terminal 380. The communication module 120 and the front end module 370 may be connected by a feed line 381. The patch antenna 500 included in the antenna device 301 may transmit and receive horizontally polarized waves of electric waves.

Figure 24:
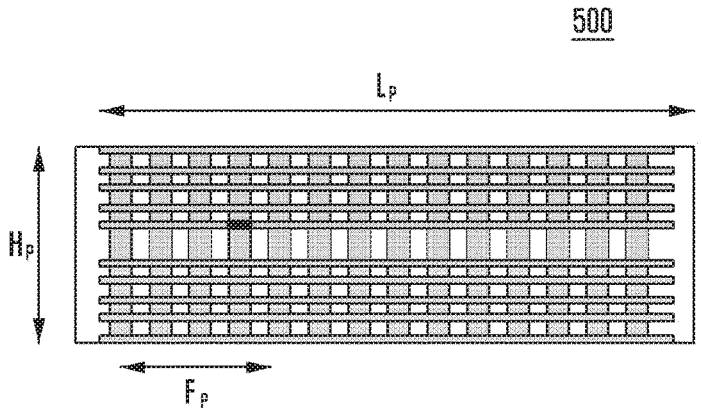
FIG. 24 is a diagram illustrating a patch antenna according to various embodiments of the present disclosure.

FIG. 24 is a diagram illustrating a patch antenna 500 according to various embodiments of the present disclosure.

Referring to FIG. 24, in the patch antenna 500, at least one rectangular micro strip patch antenna may be layered. A resonant frequency and a bandwidth of the antenna device 301 may be changed according to an entire length and an entire height of the patch antenna 500 and a separation distance between rectangular micro strip patch antennas. For example, a resonant frequency and a bandwidth may be changed according to an entire length LP and an entire height HP of the patch antenna 500 and a distance FP between micro strip patch antennas.

Figure 25:
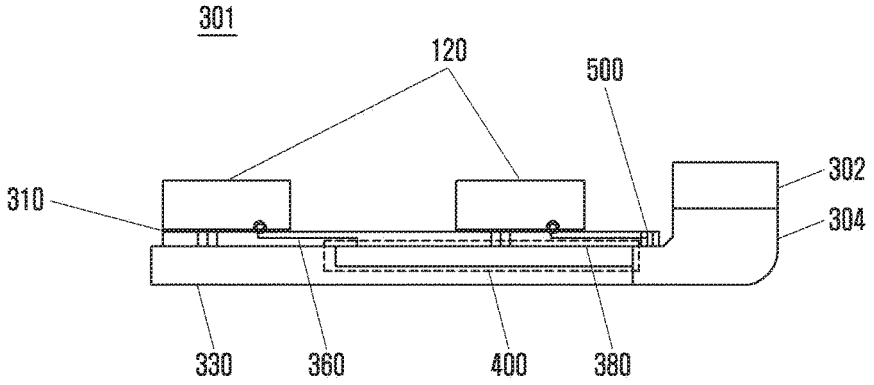
FIG. 25 is a diagram illustrating an antenna device according to various embodiments of the present disclosure.

FIG. 25 is a diagram illustrating an antenna device 301 according to various embodiments of the present disclosure.

Referring to FIG. 25, the antenna device 301 may include a waveguide antenna 400, first circuit board 310, and insulator 304. The waveguide antenna 400 may be formed by coupling to the cover 330, the first circuit board 310, and the insulator 304. The waveguide antenna 400 may be electrically connected to the communication module 120 coupled to the first circuit board 310 through the feed terminal 360. In the first circuit board 310, the patch antenna 500 and a front end module 370 may be connected by the feed terminal 380. The communication module 120 and the front end module 370 may be connected by a feed line. The patch antenna 500 included in the antenna device 301 may transmit and receive horizontally polarized waves of electric waves.

FIGS. 26A, 26B, 26C, 26D, 26E to 26F are diagrams illustrating a feed structure of a waveguide antenna 600 according to various embodiments of the present disclosure.

Figure 26A:
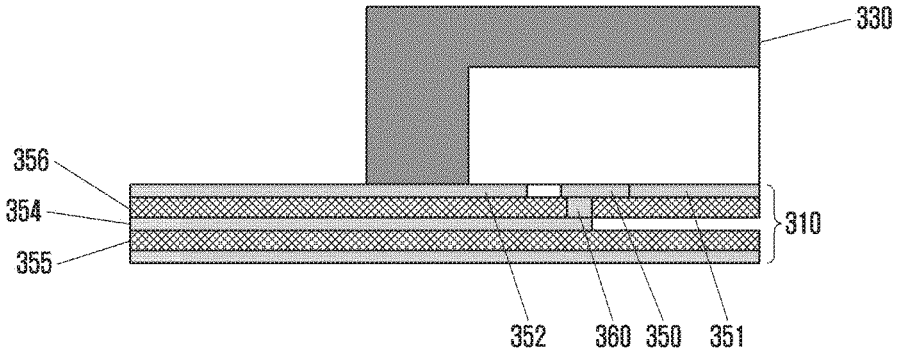
FIGS. 26A, 26B, 26C, 26D, 26E, and 26F are diagrams illustrating a feed structure of a waveguide antenna according to various embodiments of the present disclosure.

Referring to FIG. 26A, in the first circuit board 310, feed layers and insulating layers may be layered by intersection. In the first circuit board 310, in a layer adjacent to the cover 330, a first feed terminal 350, second feed terminal 351, and third feed terminal 352 may be disposed. In the first circuit board 310, in a lower portion of a layer in which the first feed terminal 350, the second feed terminal 351, and the third feed terminal 352 are disposed, an insulating layer 356 and a fourth feed terminal 360 (the same as the feed terminal 260 of FIGS. 19 to 22) that connects the first feed terminal 350 and a fifth feed terminal 354 may be disposed. In the first circuit board 310, in a lower portion of a layer in which the insulating layer 356 and the fourth feed terminal 360 are disposed, the fifth feed terminal 354 may be disposed. In the first circuit board 310, in a lower portion of a layer in which the fifth feed terminal 354 is disposed, an insulating layer 355 may be disposed.

The first feed terminal 350 and the second feed terminal 351 may be connected, and the third feed terminal 352 may be separated from the first feed terminal 350 and the second feed terminal 351. The third feed terminal 352 may be connected to the cover 330, and the waveguide antenna 600 may radiate a feed signal or may receive electric waves through the first feed terminal 350, the fourth feed terminal 360, and the fifth feed terminal 354.

Figure 26B:
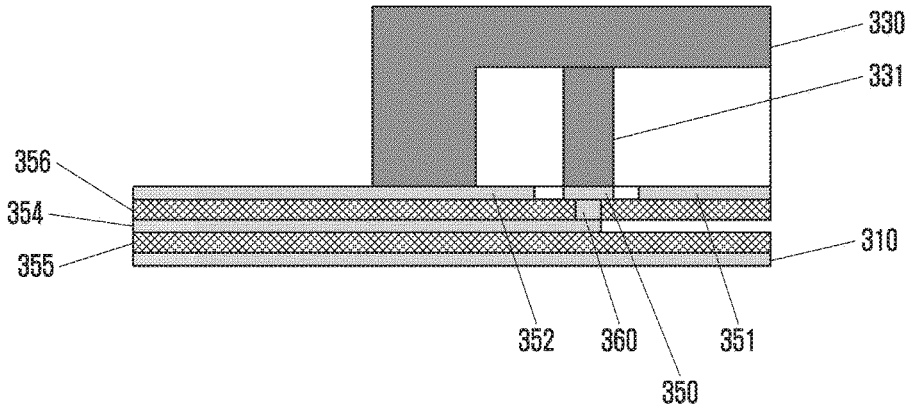

Referring to FIG. 26B, in the first circuit board 310, feed layers and insulating layers may be layered by intersection. In the first circuit board 310, in a layer adjacent to the cover 330, the first feed terminal 350, the second feed terminal 351, and the third feed terminal 352 may be disposed. In the first circuit board 310, in a lower portion of a layer in which the first feed terminal 350, the second feed terminal 351, and the third feed terminal 352 are disposed, the insulating layer 356 and the fourth feed terminal 360 (the same as the feed terminal 260 of FIGS. 19 to 22) that connects the first feed terminal 350 and the fifth feed terminal 354 may be disposed. In the first circuit board 310, in a lower portion of a layer in which the insulating layer 356 and the fourth feed terminal 360 are disposed, the fifth feed terminal 354 may be disposed. In the first circuit board 310, in a lower portion of a layer in which the fifth feed terminal 354 is disposed, the insulating layer 355 may be disposed.

The first feed terminal 350, the second feed terminal 351, and the third feed terminal 352 may be separated from each other. The third feed terminal 352 may be connected to the cover 330, and the first feed terminal 350 and the cover 330 may be connected through a first waveguide structure 331. The first waveguide structure 331 may have a cross-section of a rectangular structure and may have a structure connected to an upper portion of a vertical direction from the first feed terminal 350 to the cover 330. The waveguide antenna 600 may radiate a feed signal or may receive electric waves through the first feed terminal 350, the fourth feed terminal 360, and the fifth feed terminal 354.

Figure 26C:
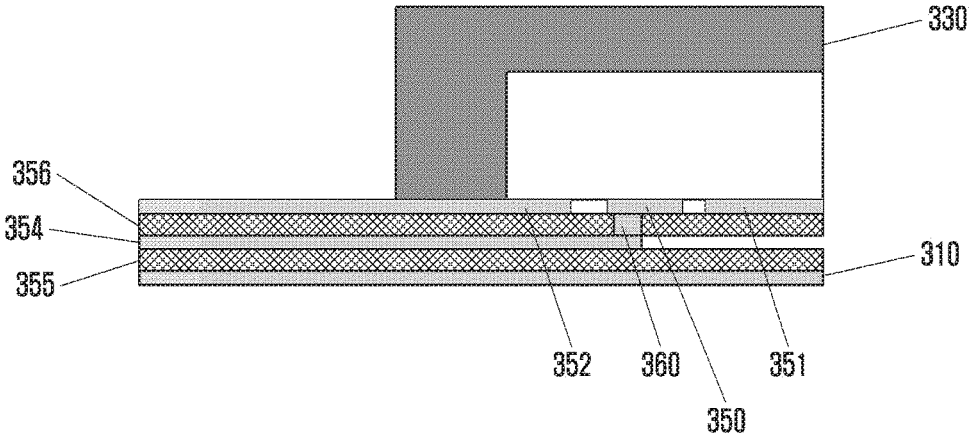

Referring to FIG. 26C, in the first circuit board 310, feed layers and insulating layers may be layered by intersection. In the first circuit board 310, in a layer adjacent to the cover 330, the first feed terminal 350, the second feed terminal 351, and the third feed terminal 352 may be disposed. In the first circuit board 310, in a lower portion of a layer in which the first feed terminal 350, the second feed terminal 351, and the third feed terminal 352 are disposed, the insulating layer 356 and the fourth feed terminal 360 (the same as the feed terminal 260 of FIGS. 19 to 22) that connects the first feed terminal 350 and the fifth feed terminal 354 may be disposed. In the first circuit board 310, in a lower portion of a layer in which the insulating layer 356 and the fourth feed terminal 360 are disposed, the fifth feed terminal 354 may be disposed. In the first circuit board 310, in a lower portion of a layer in which the fifth feed terminal 354 is disposed, the insulating layer 355 may be disposed.

The first feed terminal 350, the second feed terminal 351, and the third feed terminal 352 may be separated from each other. The waveguide antenna 600 may radiate a feed signal or may receive electric waves through the first feed terminal 350, the fourth feed terminal 360, and the fifth feed terminal 354.

Figure 26D:
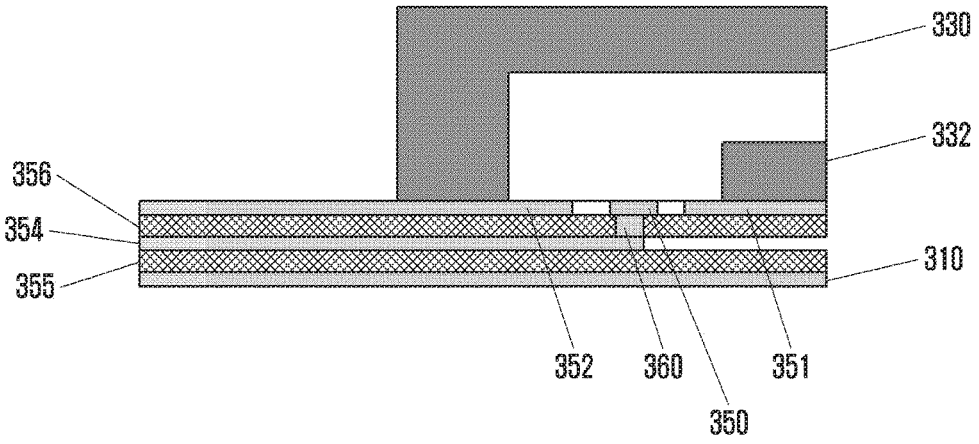

Referring to FIG. 26D, in the first circuit board 310, feed layers and insulating layers may be layered by intersection. In the first circuit board 310, in a layer adjacent to the cover 330, the first feed terminal 350, the second feed terminal 351, and the third feed terminal 352 may be disposed. In the first circuit board 310, in a lower portion of a layer in which the first feed terminal 350, the second feed terminal 351, and the third feed terminal 352 are disposed, the insulating layer 356 and the fourth feed terminal 360 (the same as the feed terminal 260 of FIGS. 19 to 22) that connects the first feed terminal 350 and the fifth feed terminal 354 may be disposed. In the first circuit board 310, in a lower portion of a layer in which the insulating layer 356 and the fourth feed terminal 360 are disposed, the fifth feed terminal 354 may be disposed. In the first circuit board 310, in a lower portion of a layer in which the fifth feed terminal 354 is disposed, the insulating layer 355 may be disposed.

The first feed terminal 350, the second feed terminal 351, and the third feed terminal 352 may be separated from each other. The third feed terminal 352 may be connected to the cover 330. A second waveguide structure 332 may be separated from the cover 330 and may be connected to the second feed terminal 351. The second waveguide structure 332 may have a cross-section of a rectangular structure. The waveguide antenna 600 may radiate a feed signal or may receive electric waves through the first feed terminal 350, the fourth feed terminal 360, and the fifth feed terminal 354.

Figure 26E:
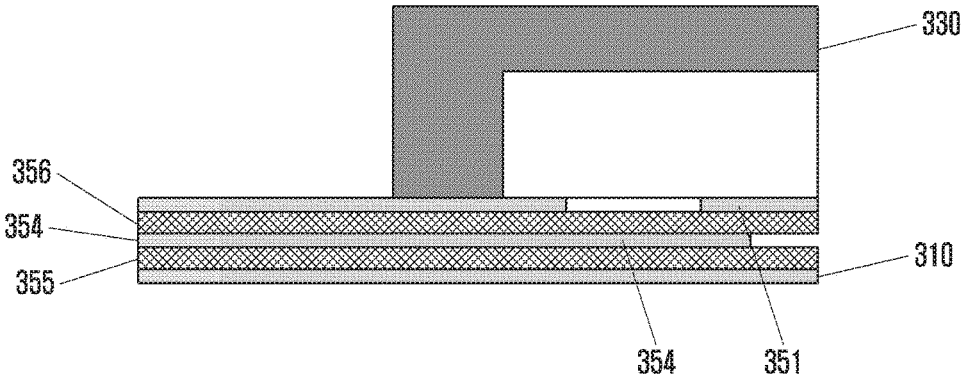

Referring to FIG. 26E, in the first circuit board 310, feed layers and insulating layers may be layered by intersection. In the first circuit board 310, in a layer adjacent to the cover 330, the second feed terminal 351 and the third feed terminal 352 may be disposed. In the first circuit board 310, in a lower portion of a layer in which the second feed terminal 351 and the third feed terminal 352 are disposed, the insulating layer 356 may be disposed. In the first circuit board 310, in a lower portion of a layer in which the insulating layer 356 is disposed, the fifth feed terminal 354 may be disposed. In the first circuit board 310, in a lower portion of a layer in which the fifth feed terminal 354 is disposed, the insulating layer 355 may be disposed.

The second feed terminal 351 and the third feed terminal 352 may be separated from each other. The third feed terminal 352 may be connected to the cover 330. The waveguide antenna 600 may radiate a feed signal or may receive electric waves through the second feed terminal 351.

Figure 26F:
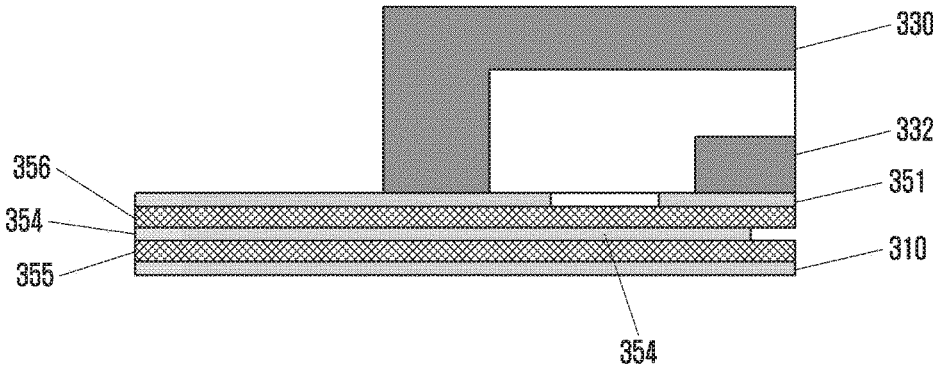

Referring to FIG. 26F, in the first circuit board 310, feed layers and insulating layers may be layered by intersection. In the first circuit board 310, in a layer adjacent to the cover 330, the second feed terminal 351 and the third feed terminal 352 may be disposed. In the first circuit board 310, in a lower portion of a layer in which the second feed terminal 351 and the third feed terminal 352 are disposed, the insulating layer 356 may be disposed. In the first circuit board 310, in a lower portion of a layer in which the insulating layer 356 is disposed, the fifth feed terminal 354 may be disposed. In the first circuit board 310, in a lower portion of a layer in which the fifth feed terminal 354 is disposed, the insulating layer 355 may be disposed.

The second feed terminal 351 and the third feed terminal 352 may be separated from each other. The third feed terminal 352 may be connected to the cover 330. The second waveguide structure 332 may be separated from the cover 330 and be connected to the second feed terminal 351. The second waveguide structure 332 may have a cross-section of a rectangular structure. The waveguide antenna 600 may radiate a feed signal or may receive electric waves through the second feed terminal 351.

Figure 27:
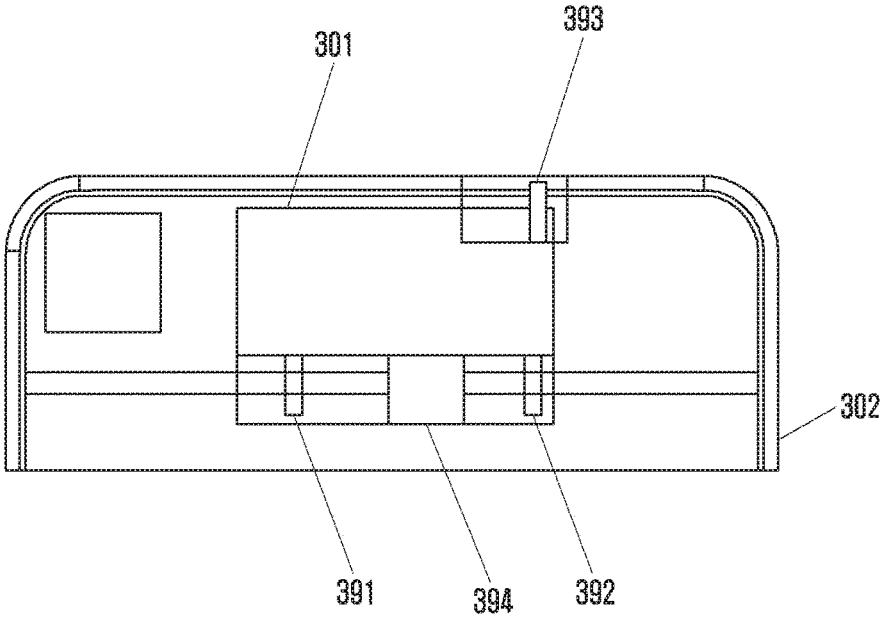
FIG. 27 is a diagram illustrating 4G band electric wave transmission and reception using an antenna device according to various embodiments of the present disclosure.

FIG. 27 is a diagram illustrating 4G band electric wave transmission and reception using an antenna device 301 according to various embodiments of the present disclosure.

Referring to FIG. 27, the antenna device 301 may include at least one feeding 391, 392, and 393 that may be connected to the frame 302 and include a ground 394. The antenna device 301 may be connected to the frame 302 through the at least one feeding 391, 392, and 393 and the ground 394 to transmit and receive 4G band electric waves.

The electronic device 101 may radiate a first band of frequency (e.g., mmWave band) through the antenna device 301 in response to a first feed signal under the control of the communication module 120. The electronic device 101 may receive a first band of frequency (e.g., mmWave band) through the antenna device 301. The first feed signal may include energy corresponding to a first band of frequency.

When transmitting and receiving a first band of frequency, at least one waveguide antenna 400, 401, 402, and 403 may transmit and receive vertically polarized waves of a first band frequency.

When transmitting and receiving a first band of frequency, the patch antenna 500 may transmit and receive vertically polarized waves of a first band frequency.

The electronic device 101 may radiate a second band of frequency (e.g., 4G band) through the antenna device 301 in response to a second feed signal under the control of the communication module 120. The electronic device 101 may receive a second band of frequency (e.g., 4G band) through the antenna device 301. The second feed signal may include energy corresponding to a second band of frequency.

When transmitting and receiving a second band of frequency, at least a portion of at least one waveguide antenna 400, 401, 402, and 403 may be used as feeding or the ground.

Figure 28:
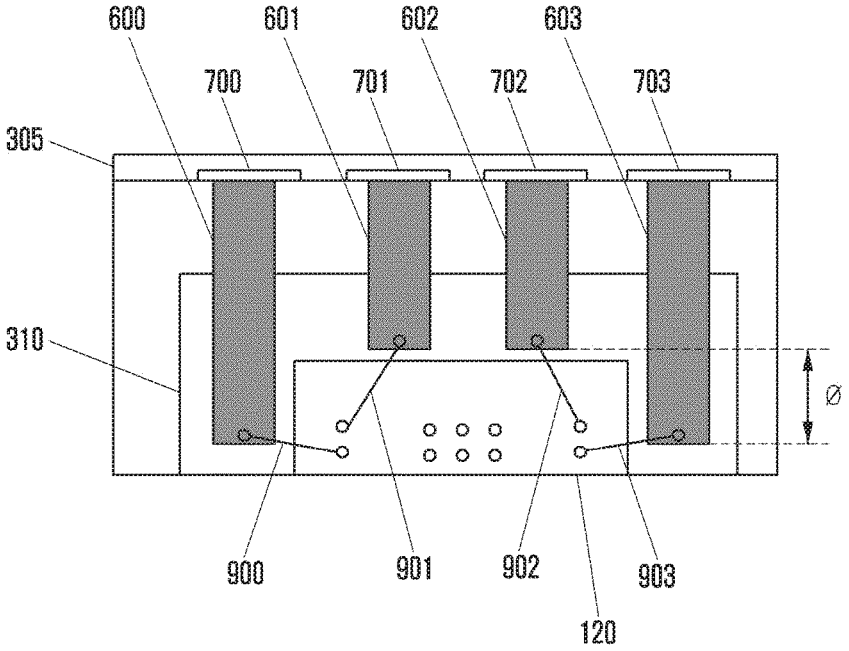
FIG. 28 is a front view illustrating an antenna device using a television metal portion of an electronic device as a waveguide antenna according to various embodiments of the present disclosure.

FIG. 28 is a front view illustrating an antenna device 800 using a television metal portion of an electronic device 101 as a waveguide antenna according to various embodiments of the present disclosure.

Referring to FIG. 28, the antenna device 800 may include at least one waveguide antenna 600, 601, 602, and 603, a first circuit board 310, and at least one insulator 700, 701, 702, and 703. The at least one insulator 700, 701, 702, and 703 may be disposed at one ends of at least one waveguide antenna 600, 601, 602, and 603, respectively, and the at least one insulator 700, 701, 702, and 703 may be disposed at a bezel 305, which is a portion of a frame of the electronic device 101. The at least one waveguide antenna 600, 601, 602, and 603 may be electrically connected to the communication module 120 coupled to the first circuit board 310 through at least one feed terminal 900, 901, 902, and 903, respectively. The first waveguide antenna 600 and the fourth waveguide antenna 603 may be disposed at both side surfaces of the electronic device 101, and at the center of the electronic device 101, the second waveguide antenna 601 and the third waveguide antenna 602 may be disposed. In a length of the waveguide antenna extended from at least one insulator 700, 701, 702, and 703, the first waveguide antenna 600 and the fourth waveguide antenna 603 may be longer than the second waveguide antenna 601 and the third waveguide antenna 602. The at least one waveguide antenna 600, 601, 602, and 603 included in the antenna device 800 may transmit and receive vertically polarized waves of electric waves.

Figure 29:
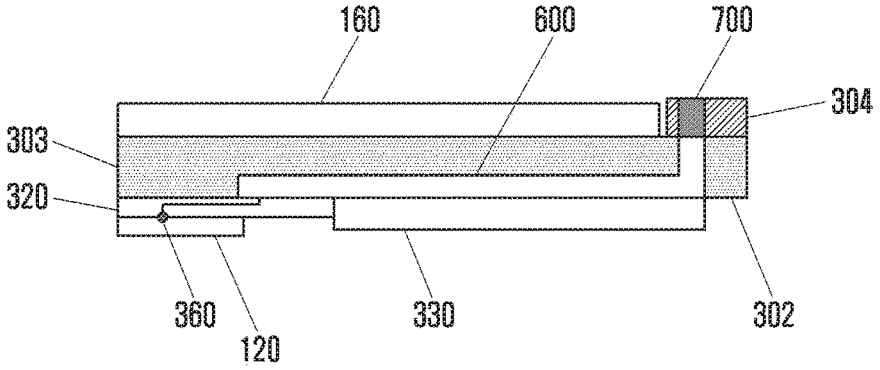
FIG. 29 is a side view illustrating an antenna device using a television metal portion of an electronic device as a waveguide antenna according to various embodiments of the present disclosure.

FIG. 29 is a side view illustrating an antenna device 800 using a television metal portion of an electronic device 101 as a waveguide antenna according to various embodiments of the present disclosure.

Referring to FIG. 29, in a lower portion of the display 160, a circuit board 310 may be disposed between the communication module 120 and the internal frame 303, and a bezel 305 including the frame 302, the cover 330, the circuit board 310, and the insulator 700 may form a cavity of an L-shaped structure to use the cavity as the waveguide antenna 600. In the waveguide antenna 600, a partial area of an L-shaped segment may be formed in a horn shape to be coupled to the insulator 700.

Further, as shown in FIG. 19, the electronic device 101 according to an embodiment of the present disclosure may include a circuit board 310 received in the electronic device and in which at least one board is layered, a communication module 120 disposed at an one surface of the circuit board 310 and electrically connected to the circuit board 310, an antenna (not shown) electrically connected to the communication module, and a metal structure whose one surface is separated from the other surface of the circuit board 310 to form a space 400 within the electronic device by enclosing the circuit board 310 and in which at least one aperture is formed at one side thereof.

In FIG. 19, the metal structure illustrates a configuration in which an upper cover 330, a lower cover 303, and a frame 302 are combined, but the metal structure may be configured with an integral material instead of a separate material of FIG. 19. That is, the upper cover 330, the lower cover 303, and the frame 302 may be configured with an integral material.

Further, the electronic device 101 may further include a bezel disposed along an edge thereof. In this case, the metal structure may be extended to one side of the bezel, and the at least one aperture may be disposed at one side of the bezel.

That is, the bezel may be disposed along an edge of the electronic device 101 (e.g., to enclose the insulator 304 of FIG. 19), and the space 400 formed by the metal structure and the circuit board 310 may form an aperture to one side of the bezel. (In FIG. 19, a surface in which the space 400 and the insulator 304 contact may be an aperture).

When the electronic device 101 is formed in such a structure, beams radiated through the antenna may be guided through the metal structure to be radiated to the outside of the electronic device 101 through the at least one aperture.

As shown in FIG. 20, the metal structure may be formed such that a cross-sectional area of the space reduces from the aperture to a specific point. That is, the metal structure may be formed such that the space has a horn shape.

A term "module" used in this document includes a unit configured with hardware, software, or firmware and may be interchangeably used with a term such as a logic, logic block, component, or circuit. The "module" may be an integrally configured component or a minimum unit or a portion thereof that performs at least one function. The "module" may be implemented mechanically or electronically and may include, for example, an application-specific integrated circuit (ASIC) chip, field-programmable gate arrays (FPGAs), and a programmable logic device that perform any operation and that are known or to be developed in the future. At least a portion of a device (e.g., modules or functions thereof) or a method (e.g., operations) according to various embodiments may be implemented with an instruction stored at a computer readable storage medium (e.g., the memory 830) in a form of a program module. When the instruction is executed by a processor (e.g., the processor 820), the processor may perform a function corresponding to the instruction. A computer readable recording medium may include a hard disk, floppy disk, magnetic medium (e.g., magnetic tape), optical recording medium (e.g., CD-ROM, DVD), magnetic-optical medium (e.g., floptical disk), and internal memory. The instruction may include a code made by a compiler or a code that may be executed by an interpreter. A module or a programming module according to various embodiments may include at least one of the foregoing elements, may omit some elements, or may further include another element. According to various embodiments, operations performed by a module, a program module or another constituent element may be sequentially, parallelly, repeatedly, or heuristically executed, at least some operation may be executed in different order or omitted, or another operation may be added.

An antenna device and an electronic device including the same according to various embodiments of the present disclosure can transmit and receive a frequency of various bands as well as a frequency of a mmWave band.

While the present disclosure has been shown and described with reference to various embodiments thereof, it will be understood by those skilled in the art, that various changes in form and details may be made therein without departing from the spirit and scope of the present disclosure as defined in the appended claims and their equivalents.

What is claimed is:

1. An electronic device, comprising:

a circuit board included in the electronic device having at least one board that is layered;

a bezel disposed along an edge of the electronic device;

a communication module disposed at one surface of the circuit board and electrically connected to the circuit board;

an antenna electrically connected to the communication module; and a metal structure whose one surface is separated from another surface of the circuit board to form a space within the electronic device by enclosing the circuit board so as to form at least one aperture at one side thereof, wherein the metal structure is extended to one side of the bezel, and the at least one aperture is disposed at one side of the bezel.

2. The electronic device of claim 1, wherein the metal structure guides beams radiated through the antenna to be radiated to the outside of the electronic device through the at least one aperture.

3. The electronic device of claim 1, wherein the metal structure reduces a cross-sectional area of the space from the at least one aperture to a specific point.

4. The electronic device of claim 1, wherein the metal structure is coupled to a dielectric substance disposed at one surface of the electronic device and the at least one aperture.

5. An electronic device comprising a frame and a cover, the electronic device comprising:

an antenna structure having at least a portion connected to the cover disposed at a first surface, wherein the antenna structure comprises:

a circuit board in which at least one board is layered, at least one waveguide using at least a portion of the circuit board and at least a portion of the cover, an antenna disposed at one end of the circuit board, a communication module disposed at the circuit board, and a feed terminal disposed at the circuit board to electrically connect the at least one waveguide and the communication module, and wherein the antenna is separated by a specific distance or more from a dielectric substance constituting a portion of the frame.

6. The electronic device of claim 5, wherein the at least one waveguide has a horn structure in which a cross-sectional area of a waveguide reduces from an aperture to a specific point.

7. The electronic device of claim 6, wherein the at least one waveguide is coupled to a dielectric substance disposed at the frame and the aperture.

8. The electronic device of claim 5, wherein the at least one waveguide has a waveguide having a rectangular cross-sectional area by coupling of a partial area of the cover and the circuit board.

9. The electronic device of claim 5, wherein the antenna structure radiates a first band of frequency according to a first feed signal transferred through the feed terminal under the control of the communication module.

10. The electronic device of claim 9, wherein the antenna structure radiates a second band of frequency lower than the first band of frequency according to a second feed signal transferred through the feed terminal under the control of the communication module.

11. The electronic device of claim 10, wherein the antenna structure enables the at least one waveguide to radiate vertically polarized electric waves, when radiating the first band of frequency.

12. The electronic device of claim 5, wherein the antenna includes at least one patch antenna which is layered.

13. An electronic device comprising a frame, the electronic device comprising:

an antenna structure having at least a portion connected to the frame, wherein the antenna structure comprises:

a circuit board in which at least one board is layered, an antenna disposed in at least a portion of the circuit board, a communication module disposed at the circuit board, and a feed terminal disposed at the circuit board to electrically connect the antenna and the communication module, wherein the antenna comprises:

at least one vertical polarization antenna having a portion coupled to the circuit board and the frame, and at least one horizontal polarization antenna having a portion coupled to the circuit board, and wherein the at least one horizontal polarization antenna has a plate-shaped tapered structure having a slot.

14. The electronic device of claim 13, wherein the at least one vertical polarization antenna comprises:

a first metal plate coupled to at least a portion of a first surface of the circuit board, and a second metal plate coupled to at least a portion of a second surface of the circuit board, wherein the first metal plate and the second metal plate form a separated space, and wherein a dielectric substance is disposed within the separated space.

15. The electronic device of claim 14, wherein the at least one horizontal polarization antenna has a plate-shaped tapered structure having a reducing slot size when receded from an opening line on the first metal plate to form a specific angle.

16. The electronic device of claim 15, wherein the electronic device comprises a cover at the rear surface, and wherein the first metal plate configures at least a portion of the cover.

17. The electronic device of claim 16, wherein the first metal plate is separated from the cover to be disposed on the cover.

18. The electronic device of claim 14, wherein one end of the first metal plate is connected to the circuit board, and another end of the first metal plate is separated from the frame.

19. The electronic device of claim 14, wherein one end of the second metal plate is connected to the frame, and the other end of the second metal plate is connected to the circuit board.

20. The electronic device of claim 14, wherein a separation distance between the first metal plate and the second metal plate decreases in a tapered structure to form a specific angle as a distance from an aperture increases.

21. The electronic device of claim 13, wherein the antenna structure radiates a first band of frequency according to a first feed signal transferred through the feed terminal under the control of the communication module.

22. The electronic device of claim 21, wherein the antenna structure radiates a second band of frequency lower than the first band of frequency according to a second feed signal transferred through the feed terminal under the control of the communication module.

23. An electronic device comprising:

a housing comprising a first surface, a second surface facing in a direction opposite to the first surface, and a side surface enclosing a space between the first surface and second surface;

a first conductive member included in the housing;

an opening portion included in the first conductive member and extended in a direction vertical to the first conductive member; and a waveguide comprising the opening portion, wherein the waveguide is at least a portion of a first antenna that transmits a signal of a first frequency range, and wherein the first conductive member is at least a portion of a second antenna that transmits a signal of a second frequency range.

24. The electronic device of claim 23, further comprising:

a second conductive member, wherein at least a partial surface of one surface of the opening portion extended in a direction vertical to the first conductive member is electrically opened, and wherein the second conductive member is coupled to the electrically opened surface to perform a function of the waveguide.

25. The electronic device of claim 24, further comprising:

a printed circuit board (PCB), wherein the second conductive member is included in the PCB, and wherein the PCB comprises a circuit that transmits and receives a signal of the first frequency range.

* * * * *